US009650855B2

(12) United States Patent
Caldwell et al.

(10) Patent No.: US 9,650,855 B2
(45) Date of Patent: May 16, 2017

(54) RISER DISCONNECT PACKAGE FOR LOWER MARINE RISER PACKAGE, AND ANNULAR-RELEASE FLEX-JOINT ASSEMBLIES

(71) Applicant: SAFESTACK TECHNOLOGY L.L.C., Cypress, TX (US)

(72) Inventors: William Matthew Caldwell, Ocean Springs, MS (US); Andrew Bennett Boyd, Houston, TX (US); Scott Andrew Wagner, Cypress, TX (US); Stephen John Walker, Houston, TX (US)

( * ) Notice: Subject to any disclaimer, the term of this patent is extended or adjusted under 35 U.S.C. 154(b) by 0 days.

(21) Appl. No.: 14/205,224

(22) Filed: Mar. 11, 2014

(65) Prior Publication Data

US 2014/0262307 A1 Sep. 18, 2014

Related U.S. Application Data

(60) Provisional application No. 61/802,136, filed on Mar. 15, 2013.

(51) Int. Cl.

| | |
|---|---|
| ***E21B 33/038*** | (2006.01) |
| ***E21B 17/02*** | (2006.01) |
| ***E21B 19/00*** | (2006.01) |
| ***E21B 33/064*** | (2006.01) |

(52) U.S. Cl.

CPC ..... *E21B 33/038* (2013.01)

(58) Field of Classification Search

None

See application file for complete search history.

(56) References Cited

U.S. PATENT DOCUMENTS 3,847,215 A 11/1974 Herd
4,099,699 A * 7/1978 Allen ..... E21B 33/06 251/1.2
4,214,842 A 7/1980 Franks
(Continued)

FOREIGN PATENT DOCUMENTS

WO WO 2012177650 A2 12/2012

OTHER PUBLICATIONS

International Search Report and Written Opinion, PCT/US2014/026676, mailed Jul. 21, 2014.

*Primary Examiner* — Matthew R Buck
*Assistant Examiner* — Douglas S Wood
(74) *Attorney, Agent, or Firm* — Richard G. Eldredge

(57) ABSTRACT

A riser disconnect/reconnect system including a disconnection package (RDP) and a modified lower marine riser package (LMRP) are provided for quick disconnection of the marine drilling riser (MDR) from the LMRP. The RDP includes a flex joint and a release connector (RC) with a mandrel that engages a modified LMRP. In an emergency event, the RDP is disconnected from the LMRP allowing access to the BOP stack for emergency intervention. In routine drilling operations, the RDP is disconnected from the LMRP facilitating the recovery of the LMRP or BOP stack to the surface for repair or maintenance without recovering the MDR. The RC joins the flex joint to the uppermost annular blowout preventer in the LMRP. The RC is configured for use in a standard or inverted position. Also provided is a mechanical locking connector, a resident ROV and sonar technology and methods of using same with the RDP.

39 Claims, 27 Drawing Sheets

(56) References Cited

U.S. PATENT DOCUMENTS

| | | | | |
|---|---|---|---|---|
| 4,219,223 | A * | 8/1980 | Schulte | E21B 33/038 285/120.1 |
| 4,676,209 | A * | 6/1987 | Etoh | F02B 19/18 123/262 |
| 4,712,620 | A * | 12/1987 | Lim | E21B 19/006 166/355 |
| 5,046,896 | A | 9/1991 | Cole | |
| 5,676,209 | A * | 10/1997 | Reynolds | E21B 17/012 166/345 |
| 6,227,300 | B1 | 5/2001 | Cunningham et al. | |
| 7,921,917 | B2 * | 4/2011 | Kotrla | E21B 33/035 166/339 |
| 8,109,223 | B2 * | 2/2012 | Jamieson | B63G 8/001 114/312 |
| 8,317,234 | B2 * | 11/2012 | McKay | E21B 33/038 285/18 |
| 8,317,235 | B2 * | 11/2012 | Kipker | F16B 2/245 285/406 |
| 9,169,710 | B2 * | 10/2015 | Jahnke | E21B 33/038 |
| 2004/0102069 | A1 | 5/2004 | Singeetham et al. | |
| 2011/0100637 | A1 | 5/2011 | Gustafson | |
| 2011/0155386 | A1 | 6/2011 | Kotrla et al. | |
| 2012/0160509 | A1 | 6/2012 | Caldwell et al. | |
| 2012/0318521 | A1 | 12/2012 | Franklin et al. | |

* cited by examiner

SECTION A–A

RISER DISCONNECT PACKAGE FOR LOWER MARINE RISER PACKAGE, AND ANNULAR-RELEASE FLEX-JOINT ASSEMBLIES

PRIORITY

The present application claims the benefit of U.S. Provisional Application Ser. No. 61/802,136, entitled EMERGENCY DISCONNECT PACKAGE FOR LOWER MARINE RISER PACKAGE AND MODIFIED LOWER MARINE RISER PACKAGE" filed Mar. 15, 2013 and which is hereby incorporated by reference in its entirety.

BACKGROUND OF THE INVENTION

1. Field of the Invention

The invention relates to subsea assemblies used in offshore deep water operations and the production of hydrocarbons. In particular, the invention relates to systems, apparatuses and methods for rapid disconnection and reconnection of a marine drilling riser from and to a lower marine riser package. More particularly, the invention relates to modified release connectors, modified flex joints, a modified lower marine riser package, modified annular blow out preventers, annular-release flex-joint assemblies and resident ROV and sonar technology as well as novel methods to utilize these components.

2. Description of the Related Art

A subsea oil well may be accessed, for example, from a mobile offshore drilling unit (MODU), by a marine drilling riser (MDR) connected to a subsea blowout preventer (BOP) stack which is attached to a subsea wellhead. The MDR is a conduit that provides an interim extension of a subsea oil well to the surface drilling equipment and is used to circulate drilling fluid back to the drilling rig. In a conventional arrangement, the MDR may be connected via a riser adapter such as a flex joint to the uppermost annular BOP of the BOP stack. Two bolted flanges, one between the flex joint and the riser, and one between the flex joint and the uppermost annular BOP, are commonly used to effect this connection.

The MDR is connected to the BOP stack. The BOP stack comprises a lower marine riser package (LMRP) and a lower BOP stack. The MDR is connected to the BOP stack via the LMRP and the LMRP is situated above and connects to the lower BOP stack. The LMRP and the lower BOP stack are usually adjoined by a hydraulically actuated connector. Most often, the LMRP includes, for example, one or two annular BOPs while the lower stack comprises a series of ram BOPs of different types.

A prior art LMRP, includes a riser connector, a flex joint, annular blow out preventers, control pods, control lines and other components, all surrounded by a protective cage-like structure that provides structural integrity to the assembled system. The LMRP may also include, for example, the controls for both the annular BOPs of the LMRP and the ram BOPs of the lower stack, as well as (portions of) control lines such as kill, choke, hydraulic supply, boost, emergency bypass, an interface for a remotely operated vehicle (ROV) to operate the subsea system.

Currently accepted contingency for emergency well intervention/containment in deepwater is to disconnect the LMRP from the lower BOP, expose the connector mandrel on the top of the lower BOP, which would provide a connection point for a capping stack or similar containment system. In an emergency scenario with a prior art LMRP, should it not be possible to effect the disconnection of the LMRP from the lower BOP it may be necessary to effect a subsea disconnection of the MDR from the LMRP which would involve unbolting of the MDR from the riser adapter above the flex joint or other accessible adapter above the flex joint or unbolting the flex joint from the uppermost annular BOP. These scenarios would also require the bolting of a mandrel onto the exposed flange above the flex joint or to the uppermost annular BOP, and affixing another BOP, capping stack or containment system over the uppermost annular BOP or above the flex joint, similar to the intervention required on the BP Macondo subsea equipment. Affixing the capping stack above the flex joint is likely to be the only feasible option but introduces significant risk to the well control scenario as the flex joint is typically only rated to 5,000 psi working pressure, considerably less than the other components in the BOP system. Additionally, effecting these connections and disconnections, which would need to be done by underwater robotic vehicles, is complex, hazardous, costly and time-consuming.

In the case of an emergency such as the uncontrolled flow of oil from the well or failure of a BOP, the MDR may have to be disconnected from the LMRP, brought up to the drilling rig at the surface so as to provide access to the LMRP and its controls. The routine or emergency recovery of the MDR to the surface to facilitate access to the LMRP is also a very hazardous, costly, time-consuming and challenging procedure because of the MDR's significant size and weight. In deep water this operation could take several days and, therefore, significantly delay the installation of well control equipment in an emergency situation or cause significant drilling rig downtime during routing drilling operations.

Following the oil well blowout of the BP Macondo well in the Gulf of Mexico, government and industry interests have focused attention upon new and practical technology that facilitates the containment, control and suppression of a similar occurrence should a blowout occur sometime in the future. Most approaches, however, have been to enhance BOP functionality and to utilize an approach which integrates to existing subsea components and connection points instead of actively addressing the shortcomings of current components within the BOP unitization stack. Therefore, there is a need for an approach that would provide additional intervention capability than exists today allowing the use of a second blowout prevention system to re-enter the wellbore through the disabled equipment and attaching a plug, collection dome or capping stack with methods not currently available.

Embodiments of the present disclosure address the aforementioned shortcomings in the prior art. For example, the current invention provides for improved access to the LMRP during emergency or routine drilling operations, provides a means of effecting emergency well intervention or routine LMRP maintenance without the need to recover the MDR to the MODU, provides novel flex joints, connectors, annular BOPs, resident remote operated vehicles, sonar technology, mandrels with seal plates, higher annular bypass capabilities and alternative containment devices as well as flex joint-connector-annular assemblies that help reduce the height of the riser interface/LMRP/BOP stack and provide additional intervention options.

SUMMARY OF THE INVENTION

Systems and methods for disconnecting a marine drilling riser (MDR) from a lower marine riser package (LMRP) are provided. The system includes a marine riser disconnect package (RDP) including a disconnect/reconnect assembly and a modified LMRP for quick disconnection of the MDR from the LMRP so as to facilitate access to, or recovery of, the LMRP and/or lower BOP. The RDP is comprised of a flex joint with a release connector and a connector mandrel that engages a modified LMRP. The disconnect/reconnect assembly (hereinafter referred for simplicity by the abbreviation "Flexconn" Flexconn) is comprised of an industry standard flex joint configured with either an integral hydraulically-actuated release connector (Flexconn S) or an integral connector mandrel to engage a hydraulically-actuated release connector (Flexconn I) depending on operational requirements. A structural cage may frame the RDP and a complementary cage surrounds the LMRP. In standard drilling operations, the RDP may be disconnected from the LMRP, the MDR moved away from and out of communication with the wellbore and suspended from the cellar deck or auxiliary well center of the drilling unit facilitating the in situ repair of the LMRP, or recovery of the LMRP or BOP stack to the surface, without the need to recover the MDR to the drilling vessel. In an emergency event, the RDP may be disconnected from the LMRP providing access to the uppermost connection point of the LMRP and facilitating the installation of well control/containment apparatus such as a capping stack, a mechanical locking connector or similar equipment. The hydraulically-actuated release connector is configured for use in either a standard configuration (connector facing down), or an inverted configuration (connector facing upwards). In the inverted configuration, the release connector further includes a saddle. A modified LMRP or a modified annular BOP, in accordance with the current invention, includes a hydraulically-actuated release connector or a connector mandrel, either of which may be mounted by means of an API flanged connection to, or built integral to, the top plate of the upper annular BOP. The housing of the modified annular BOP may be a 15,000 psi rated embodiment (utilized with currently available 10,000 psi packers) so as to provide a full system pressure rating of 15,000 psi through the entire BOP stack and RDP, which equals the rating of capping stacks in use today. Additionally, the modified annular BOP may include bypass porting which facilitates the bypass of well effluent. In some embodiments of the current invention, the RDP is equipped with an a resident ROV and/or BOP sonar system. The resident ROV module or sonar system could be installed on a prior art LMRP, a modified LMRP, the lower BOP stack or a structural cage surrounding same.

In accordance with an embodiment of the invention, provided is a hydraulically-actuated release connector for a subsea assembly having a plurality of gripping segments, wherein said gripping segments rotationally pivot between a locked position in which it clamps to a mandrel and an unlocked position in which the mandrel is released; an annular piston, wherein said piston is located adjacent to the gripping segments and operable to move said segments between the locked and unlocked positions; at least one hydraulic unlock port in communication with the piston; a hydraulic lock port in communication with said piston; and a center body section disposed within the plurality of segments and configured to form a seal with the mandrel when said segments are in the locked position, wherein the annular piston and the plurality of gripping segments have complementary radiused contact surfaces. In an alternate embodiment, the release connector further includes an actuator piston head connected to said piston movable between a lock position and an unlock position, and wherein the hydraulic lock port is in communication with the actuator piston head. The hydraulically-actuated release connector may be configured for use in an inverted configuration. The release connector may connect a flex joint to a lower marine riser package or may couple an annular blow out preventer to a ram blowout preventer. In the inverted orientation, the release connector is provided with a saddle that is positioned under the connector's segments so as to provide support to said plurality of segments. In an embodiment of the invention, the release connector has a seal plate integrated into the top part of the connector. In other embodiments, the center body section of the connector is bolted to an annular blow out preventer or is integral to an annular blow out preventer or is bolted to a flex joint by means of an adapter plate.

Also in accordance with the current invention, provided are embodiments of a Flexconn assembly having a flex joint and a hydraulically-actuated release connector attached to the flex joint with the hydraulically-actuated release connector having a plurality of gripping segments, wherein the gripping segments rotationally pivot between a locked position in which it clamps to a mandrel and an unlocked position in which the mandrel is released; an annular piston, wherein the piston is located adjacent to the gripping segments and operable to move said segments between the locked and unlocked positions, at least one hydraulic unlock port in communication with the piston; a hydraulic lock port in communication with said piston; and a center body section disposed within the plurality of segments and configured to form a seal with the mandrel when said segments are in the locked position, wherein the annular piston and the plurality of gripping segments have complementary radiused contact surfaces. In an alternate embodiment, the Flexconn assembly further includes an actuator piston head connected to the piston movable between a lock position and an unlock position, and wherein the hydraulic lock port is in communication with the actuator piston head. In a further embodiment, the connector is in an inverted (funnel up) configuration, and has a saddle. In yet a further embodiment of the Flexconn, the flex joint comprises an upper section and a lower section, and wherein the lower section has a mandrel profile that is integrated into the lower section and engages the connector (Flexconn I). In some embodiments of the Flexconn assembly, the flex joint is attached to the connector by an adaptor flange and the connector is in the standard face up configuration (Flexconn S).

In another aspect, the current invention provides a marine riser disconnect package for rapid connecting and disconnecting a marine drilling riser to or from a lower mariner riser package such that the riser disconnect package includes a flex joint, a hydraulically-actuated release connector and a connector mandrel, wherein the release connector functionally connects the flex joint and the mandrel. In certain embodiments of the marine riser disconnect package, the release connector is an integral part of the flex joint. In other embodiments, the connector mandrel is integrated in the flex joint and the release connector engages the connector mandrel in an inverted configuration. In an embodiment, the marine riser disconnect package further includes a debris excluder on the release connector. The invention further provides a riser disconnect package having a structural cage framing the riser disconnect package. In some embodiments, the structural cage framing the mariner riser disconnect engages a complementary structural cage surrounding a lower mariner riser package. The marine riser disconnect package may include at least one latch/seal plate or two to engage a containment dome or a mechanical lock connector. A first seal plate maybe positioned on the flex joint and a second seal plate is either on said hydraulically-actuated release connector or on a connector mandrel. In certain embodiments of the invention, the marine riser disconnect package includes a resident ROV and/or a sonar system. The ROV and/or sonar systems may be installed on any part of the subsea stack, such as the RDP, the LMRP, the lower BOP stack, or on the structural cage.

The invention further provides a subsea assembly for an offshore well having in a functional order: a flex joint with an upper section to engage a marine drilling riser and a lower section, a connector mandrel, such that the connector mandrel is integrated into the lower section of the flex joint; a hydraulically-actuated release connector configured to engage said connector mandrel; and an annular blow out preventer, such that the release connector is an integral part of said annular blow out preventer. The subsea assembly may also include a second annular blow out preventer and a second hydraulically-actuated release connector. In a further embodiment, the subsea assembly has one or more latch/seal plate configured to receive and latch to a containment dome or a mechanical lock connector, such that a first latch/seal plate is attached to the flex joint, a second latch/seal plate is attached to the first release connector and a third latch/seal is attached to the second release connector. In certain embodiments of the subsea assembly, the flex joint and the connector mandrel are housed in a first cage and the first annular and the second annular are housed in a second cage, such that the first cage is configured to mate with the second cage. The annular of the subsea assembly may comprise one or more by-pass ports.

In yet other embodiments, the current invention provides a subsea assembly for an offshore well comprising in a functional order: a flex joint configured on one end to engage a marine drilling riser; a hydraulically-actuated release connector configured to engage a second end of said flex joint, a connector mandrel configured to engage said release connector; and an annular blow out preventer having a top section and a bottom section, wherein said connector mandrel is an integral part of said top section. The subsea assembly may also contain a second annular blow out preventer. and a second hydraulically-actuated release connector. The subsea assembly can further include one or more latch/seal plates on the connector mandrel or on the flex joint, receive and latch to a containment dome or a mechanical locking connector. The subsea assembly can also include a second connector mandrel configured to engage the second release connector wherein the second connector mandrel comprises integrated within a third seal plate. In some embodiments, the flex joint and said connector mandrel are housed in a first cage and the first and second annular blow out preventers are housed in a second cage, wherein the first cage is configured to mate with the second cage. In certain embodiments, the annular blow out preventer includes at least one by-pass port.

The invention also provides a latch/seal plate on the FlexConn assembly (either on the flex joint or connector) and/or at the modified LMRP to facilitate the installation of a containment dome or mechanical locking connector (MLC) should the connection of a capping stack on the LMRP prove to be unachievable (e.g., the BOP stack is bent and no longer perpendicular to the seabed making the connection of a capping stack difficult or impossible). In some embodiments, the dome or MLC may include outlets for diverting flow.

The current invention provides modified flex joints comprising integrated therein either a mandrel or a center body section of a release connector. The modified flex joint may further contain a latch/seal plate to effect the latching of a containment dome to the flex joint.

The current invention also provides modified mandrels. The modified mandrels may include a latch/seal plate to effect the latching of a containment dome or an MLC to the mandrel. The modified mandrels may be bolted to or integrated into the top plate of an annular BOP or a lower section of a flex joint. The modified mandrels may also be bolted to a lower BOP stack, for example, via an API spool.

The current invention also provides for modified annular blowout preventers. In an embodiment, the annular is modified to have integrated within its top plate a mandrel. The mandrel can include a latch/seal plate that engages a containment dome or a mechanical locking connector. In alternate embodiments of the current invention, the modified annular blowout preventer has integrated into its top plate a hydraulically-actuated release connector. In yet other embodiments, a lower section of a modified annular blowout preventer, in accordance with the current invention, includes a mandrel or a hydraulically-actuated connector.

The current invention also provides for containment domes to latch on a subsea assembly. The containment domes includes a latch lock and a plurality of spring latches that are configured to latch onto a latch/seal plate. In different embodiments of the invention, the dome engages a latch/seal plate located on a flex joint or on a hydraulically-actuated release connector or a mandrel of a subsea assembly.

Moreover, the current invention provides a flex joint-connector subassembly, Flexconn S (or standard configuration), comprising a flex joint modified such that its lower part comprises the body center section of a release connector. In a further embodiment, the flex joint-connector assembly, hereinafter Flexconn I (or inverted configuration) comprises a flex joint modified such that its lower part comprises integrated therein a mandrel that engages a release connector.

Further provided is a method of retrieving an LMRP in an offshore drilling operation comprising disconnecting the MDR from an LMRP, disconnecting the LMRP from the lower BOP stack, and retrieving the LMRP without the MDR to the surface. The lower BOP stack may also be retrieved to the MODU while leaving the MDR suspended from the vessel. Furthermore, the current invention provides a method for retrieving a lower marine riser package to a mobile offshore drilling unit including disconnecting a marine drilling riser from said lower marine riser package, suspending said marine drilling riser from the drilling unit, disconnecting said lower marine riser package from said lower blowout preventer stack and retrieving the lower marine riser package to the surface while the marine drilling riser is suspended from the drilling unit.

Also provided by this invention is a method for containing an offshore well including disconnecting a riser disconnect package from a lower marine riser package by actuating a hydraulically actuated release connector, exposing a mandrel, wherein the mandrel is connected to an upper annular blowout preventer, and affixing a capping stack or a containment dome on the mandrel.

Further provided is a method for containing a well comprising affixing a containment dome onto a seal plate to contain the well, wherein the seal plate is integrated into a flex joint, a release connector or a mandrel affixed to the top plate of an annular BOP. In an alternate embodiment, the method involves affixing a mechanical locking connector in lieu of a containment dome around a mandrel with a latch/seal plate.

In a further embodiment, provided by the current invention, is a method for containing an offshore well including disconnecting a flex joint from an upper annular blow out preventer of an lower marine riser package by actuating a hydraulically-actuated release connector integrated onto the upper annular blowout preventer and affixing a capping stack or a containment dome onto said release connector.

The invention further provides a method for containing an offshore well including disconnecting a riser disconnect package from a lower marine riser package by actuating a hydraulically-actuated release connector, exposing a mandrel that is connected to an upper annular blowout preventer and affixing a mechanical locking connector on the mandrel. Also provided is a method for containing a well during an offshore drilling operation comprising disconnecting the RDP from the LMRP, exposing a mandrel connected to the upper annular BOP, affixing a capping stack or a containment dome on the mandrel.

Yet a further embodiment of the current invention is a method for containing an offshore well comprising disconnecting the flex joint from the LMRP, exposing a release connector integrated into the upper annular BOP, affixing a capping stack or a containment dome on the release connector An alternate embodiment of the current invention is a method for containing an offshore well comprising disconnecting the FlexConn subassembly from the LMRP, exposing a mandrel integrated into the upper annular BOP, affixing a capping stack or a containment dome on the mandrel so as to contain the well.

The current invention also provides for a mechanical locking connector (MLC) that can seal or latch onto the profile of a mandrel and/or onto a latch plate and/or onto a seal plate so as to contain a well if and when necessary. In an embodiment of the current invention, the MLC maybe installed into a large dome so as to allow the dome to latch to a smaller diameter latch or seal plate. Also according to the current invention, provided is a mechanical locking connector comprising a plurality of spring latches capable of latching on a latch/seal plate of a subsea assembly. The mechanical locking connector can further comprise a seal for sealing the interface between a mandrel profile on said subsea assembly and said connector. In some embodiments the seal is a seal gasket. The mechanical locking connector can be used in a subsea assembly such as a Christmas tree, a well head, a lower marine riser stack, a blowout preventer stack or a mandrel.

In another aspect of the invention, provided is a mechanical locking connector having an enclosure with a proximal end and a distal end, a plurality of spring latches attached to the distal end of the enclosure, such that the spring latches are configured to latch to a profile on a latch/seal plate of a subsea assembly. In a further embodiment, the enclosure of the mechanical locking connector has a bore through its proximal end. In another embodiment, the proximal end of the enclosure further includes an API flange, a clamp hub or a flowline connection.

Further provided is a method for containing a well comprising affixing a mechanical locking connector onto a latch/seal plate to contain the well, wherein the latch/seal plate is integrated into a flex joint, a release connector or a mandrel affixed to the top plate of an annular BOP.

BRIEF DESCRIPTION OF THE DRAWINGS

It being understood that the figures presented herein should not be deemed to limit or define the subject matter claimed herein, the applicants' invention may be understood by reference to the following description taken in conjunction with the accompanying drawings, in which:

FIGS. 5A and 5B illustrate the structural differences, lines of contact and unlock force vectors between prior art connector components and those of the present invention.

FIG. 11A also shows containment dome and two receiving seal plates, one on the flex joint and the other integrated into the mandrel atop the annular.

FIG. 21B shows the mechanical locking connector as latched to a latch/seal plate on a mandrel. FIG. 21A is an exploded view of 21B.

DESCRIPTION OF ILLUSTRATIVE EMBODIMENTS

Figure 1:
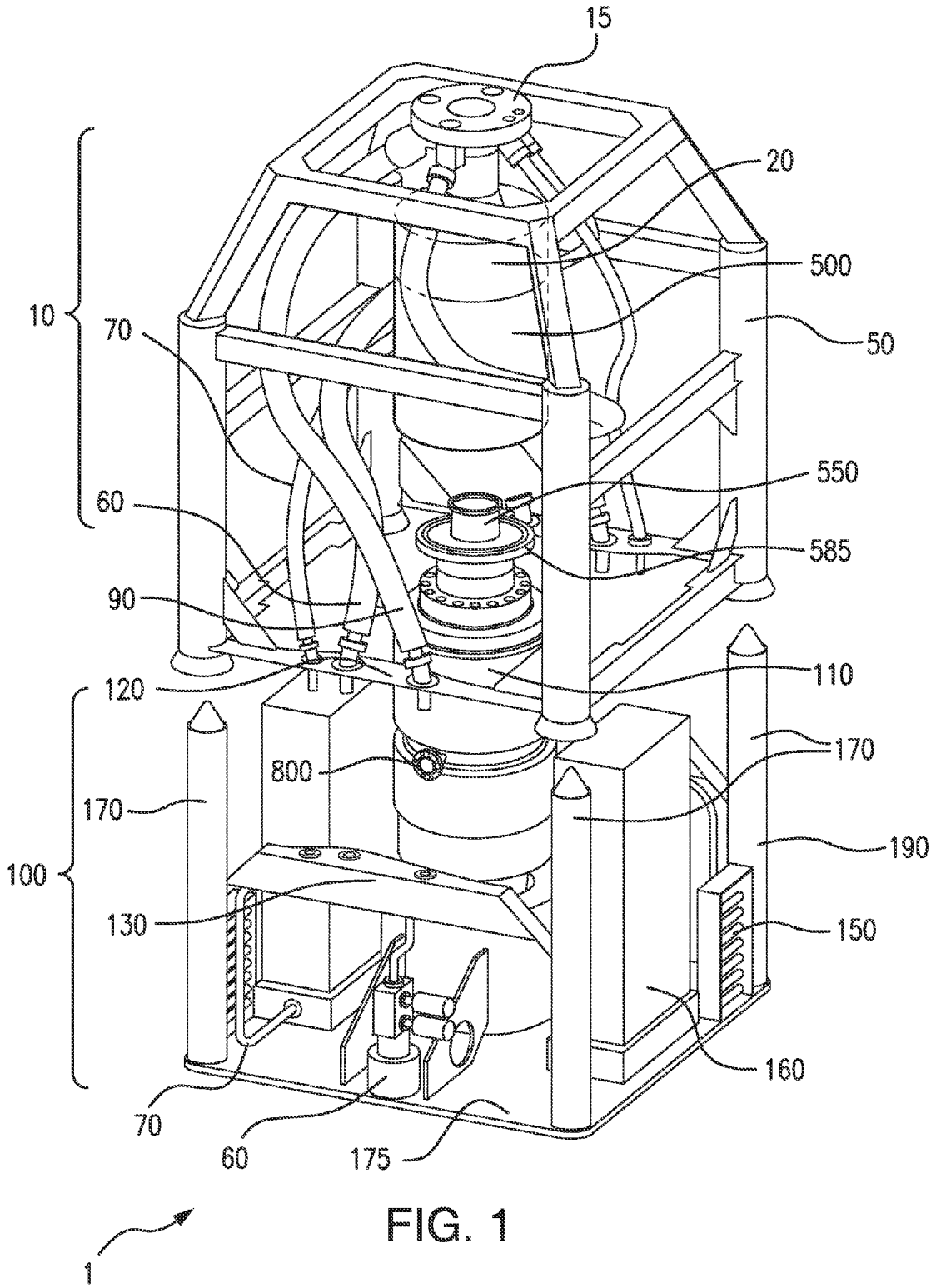
FIG. 1 shows an RDP and a modified LMRP with surrounding complementary cages (not connected to one another), according to embodiments of the invention.

Illustrative embodiments of the invention are described below. In the interest of clarity, not all features of an actual implementation are described in this specification. The following detailed description of exemplary embodiments, read in conjunction with the accompanying drawings, is merely illustrative and is not to be taken as limiting the scope of the invention. Rather, the scope of the invention is defined by the appended claims and equivalents thereof. It will of course be appreciated that in the development of an actual embodiment, numerous implementation-specific decisions must be made to achieve the design-specific goals, which will vary from one implementation to another. Moreover, it will be appreciated that such a development effort, while possibly complex and time-consuming, would nevertheless be a routine undertaking for persons of ordinary skill in the art having the benefit of this disclosure. Further aspects and advantages of the various embodiments of the invention will become apparent from consideration of the following description and drawings. It is noted, however, that the figures are not necessarily drawn to scale.

Embodiments of the present disclosure provide for quick and easy disconnection and reconnection of an MDR from an LMRP by provision of a novel riser disconnect package (RDP) and a modified LMRP. The RDP and modified LMRP of the current invention proffer novel wellbore intervention capabilities that allow wellbore re-entry, when necessary, through the attachment of a well control/containment apparatus such as a dome (at different locations on the stack), a capping stack (several types are currently used in the industry), a mechanical locking connector or similar equipment. In an emergency event, for example, the RDP may be disconnected from the LMRP providing access to the uppermost connection point of the LMRP, therefore facilitating the installation of the well control/containment equipment. The drawings of the current disclosure depict only the option of using a containment dome. However, a person of skill in the art would recognize that this is one of several well control methods that can be employed in conjunction with the various RDP and modified LMRP embodiments of the current invention. Components of the RDP and LMRP of the current invention, such as the flex joint, release connector, connector mandrel and annulars, for example, are modified to effect a quick and easy disconnection/reconnection of an MDR from/to an LMRP. The disconnection can occur at the top of the LMRP, or at the top of the lower BOP stack. When needed, the embodiments of the current invention allow the quick and efficient retrieval of the LMRP or entire BOP stack to the surface without the need to retrieve the entire MDR. The invention also provides a method of containing the well and a containment dome or mechanical locking connector that can latch, when needed, onto latch/seal plates positioned at various sites on the RDP or the LMRP. The dome or MLC may include ports or outlets for connecting flow lines to divert the flow of wellbore fluids subsea manifolds or directly to the surface or for the injection of kill or containment fluids into the well. To be noted is that the RDP and modified LMRP system described herein does not impede the use of a dual gradient drilling system. The RDP and modified LMRP of the current invention do not adversely affect the overall height of the BOP stack. Therefore, the BOP stack can still be handled on the deck of the MODU, in the various rig configurations currently found in the field.

In reference to FIG. 1, the invention provides a riser disconnect system 1 having a unitized RDP 10 and a LMRP 100 and corresponding structural cages 50 and 190, respectively. The removal of the RDP 10 simultaneously removes the MDR 2 (not shown) and thus enables clear access to the re-entry interface of the LMRP. This action exposes, for re-entry, the BOP main bore, the connection receptacles for the kill 60 and choke 90 circulation lines, the control hydraulic power supply lines 70, and the electrical power and communication lines (not shown). The unitization of the RDP generates the increased efficiency of BOP maintenance requirements associated with routine drilling operations.

As shown in FIG. 1, the RDP includes, among other components, the following: (1) a flex joint 20 having riser interface 15, integrated with (2) a high strength, high pressure modified release connector 500; (3) a connection mandrel 550 for connecting the integrated flex joint and release connector (Flexconn) to the uppermost annular BOP 110 and having latch/seal plate 585 for receiving a containment dome or mechanical locking connector (MLC) 400 (not shown) (4) stab connections to the LMRP 100; (5) structural cage 50 to house the RDP with release plate 120, and (6) alignment members for the structural cages. FIG. 1 shows a Flexconn S (standard) assembly, wherein the flex joint 20 is attached (can also be integral) to connector 500, which in turn engages mandrel 550 on annular 110. The flex joint in this type of assembly is configured to attach to the body center section of release connector 500. Such an assembly/configuration is but one of many embodiments of the current invention. Different assembly configurations are disclosed hereafter. The LMRP in accordance with the current invention includes one or more of the following components: (1) structural cage 190 having stab plate 175, which houses the LMRP and engages the RDP cage 50 along mating plate 130 and stab points 170; (2) wet mateable stab connections; and (3) modified annular BOP(s) 110 which are discussed hereafter.

Figure 2:
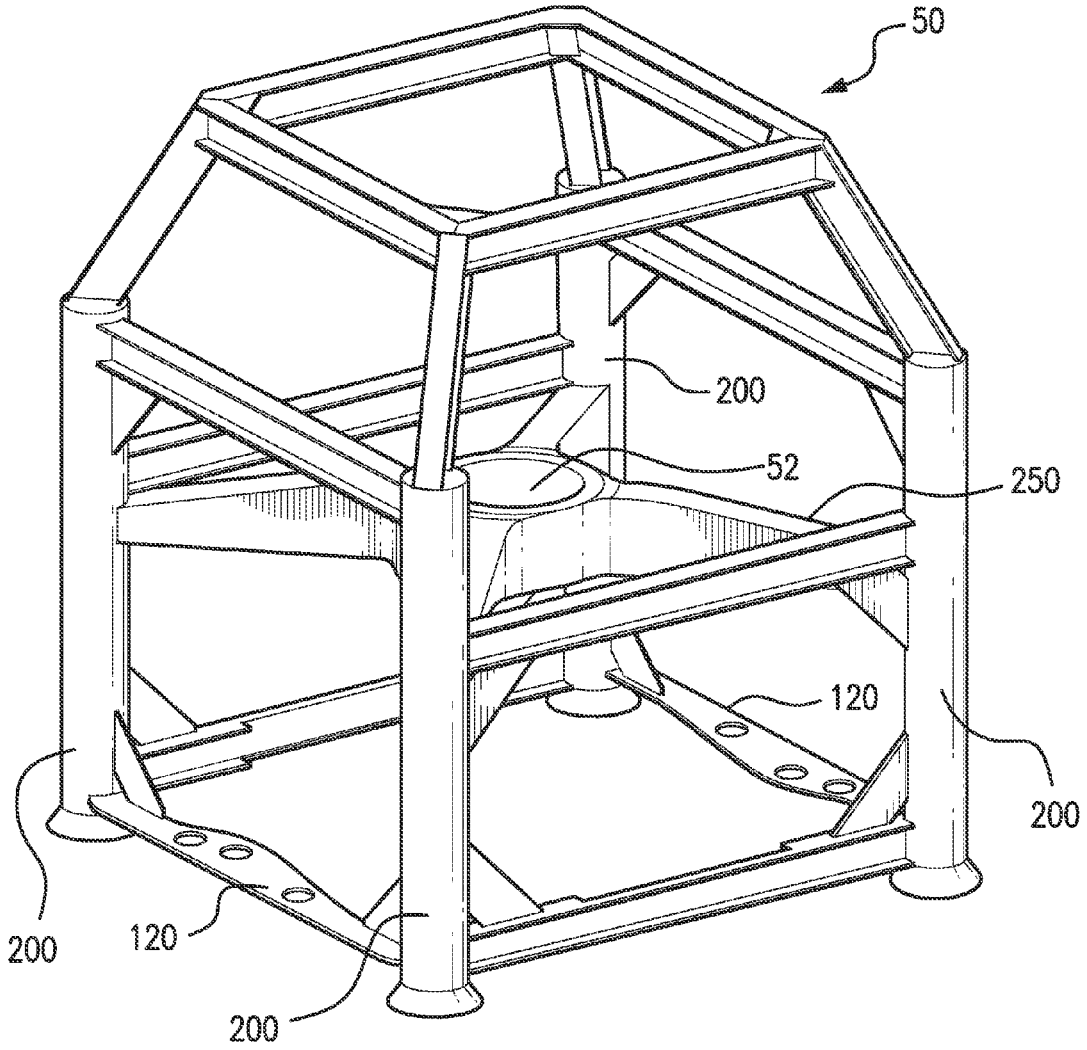
FIG. 2 is an illustration of a structural cage of an RDP, according to embodiments of the invention.

FIG. 2 shows another embodiment of an RDP cage 50 and in more details than FIG. 1. RDP cage 50 has release plates 120, and alignment sleeves 200 that engage stab points 170. The Flex-connector interface 52 is circular support structure that surrounds the flex joint and connector and has four spacers from the four corners so as to provide "support centralizing member" 250. Although not drawn to scale, structure 52 should be fabricated to accommodate the flex joint-connector subassembly. Such a structural framework enables rapid and easy disconnection and reconnection of the well control system As shown in FIGS. 1 and 2, the structural cage housing the LMRP 190 has been modified from prior art LMRP cages (not shown). For example, in a prior art LMRP cage, the cage and/or control pods extend vertically from bottom to top of the LMRP and extensively in the horizontal direction. As shown in FIGS. 1, and 2, the cage of the LMRP 190 has been modified to a more skeletal cage. The four corner beams, referred to as stab points 170, of the modified LMRP cage extend to the top of the upper annular BOP. Mating plates 130 extend horizontally across two of the sides of the cage, near the vertical midpoint of stab points 170, and near the junction of the lower and upper annular BOPs. Mating plates 130 of LMRP structural cage 190 align with release plates 120 of the RDP structural cage 50. When the RDP structural cage 50 is mated to the modified LMRP cage 190, the corresponding four alignment sleeves 200 of the RDP structural cage align and engage stab points 170 of the modified LRMP cage. When the RDP structural cage 50 and the modified LRMP cage 190 are connected, the RDP structural cage 50 extends down to the approximate vertical midpoint of the four corner beams of the modified LMRP cage 190, and the mating plates 130 of the RDP structure cage extend horizontally around the four sides of the cages near the vertical midpoint of the four corner beams of the modified LMRP cage 190. The mating plates 130 adjoin the release plates 120 of the modified LMRP cage and, as mentioned, stab connections can be established here. Effectively, the overall size of the RDP mated to the modified LMRP will be equivalent in overall dimensions to a prior art LMRP.

The modified LMRP cage 190 illustrated in FIGS. 1 and 2 are examples and variants thereof are possible. In one variant, the horizontal extent of the cage between the four corner beams below the release plate may be more extensive than that illustrated in FIGS. 1, and 2. Regardless of such variants, with the RDP and modified LMRP arrangement described herein, when the RDP is disconnected from the LMRP, the upper half of the LMRP (e.g., the upper annular BOP and the top of the lower annular BOP) is fully accessible, due to the absence of cage. That is, the structural cage of the RDP surrounds and protects the upper half of the LMRP, but disconnection of the RDP from the LMRP removes the structural cage of the RDP. Thus, disconnection of the RDP renders easy access to the LMRP, whether for routine maintenance or repair, etc. In addition, it is noted that when the RDP is disconnected from the LMRP, the LMRP controls (e.g., control pods) remain intact on the LMRP, enabling an operator to continue to control and function the BOP stack.

Figure 22:
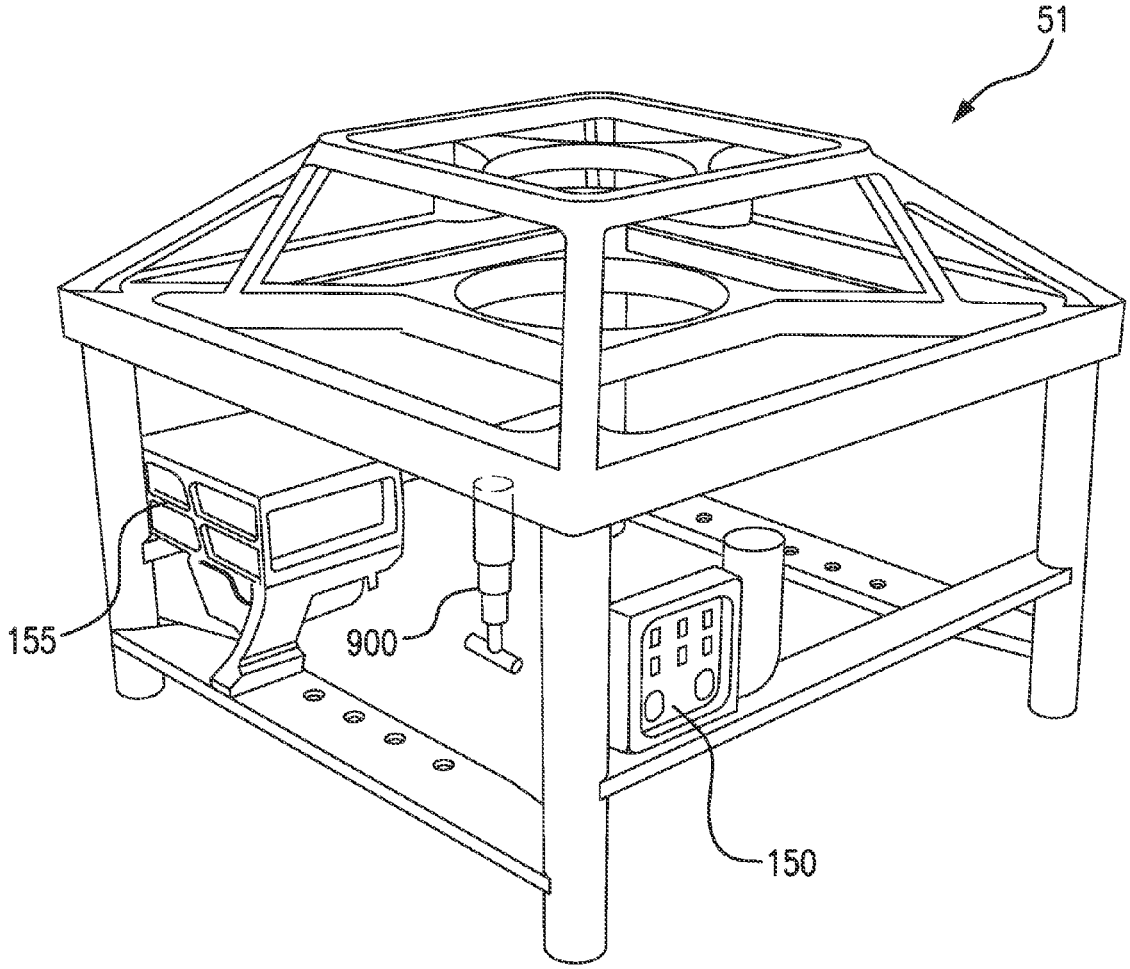
FIG. 22 is an isometric view of an embodiment of the RDP of the current invention having a resident ROV and a sonar system and also having a structural cage in accordance with an embodiment of the current invention.

The RDP structural cage in accordance with the present invention, and in its different embodiments as shown in FIGS. 1, 2 and 22, and among other functions, 1) guides and protects the Flex-Conn assembly; 2) carries connectors that enable flex lines (from the kill and choke, hydraulic supply and control umbilicals) from the riser interface of the Flex-Con assembly to mate with receptacles mounted on the LMRP; 3) enables a hydraulic separation of the ancillary lines for controlled surface maintenance procedures; and 4) provides rotational alignment of the RDP to the LMRP equipment array.

Stab connections may be provided for connecting lines between the RDP 10 and the LMRP 100 at the junction of the release plate 120 of structural cage 50 with the mating plate 130 of LMRP cage 190. Wet mateable tab connections are well known in the art. The invention further provides for releasable stabs should the need for emergency disconnection be required. In addition, the ROV interface or panel 150 are required to facilitate the function of BOP controls with a remotely operated vehicle.

Although not illustrated, injection points (ports) may be provided for injecting methanol or other chemicals/substances for the purposes of, e.g., (1) inhibiting the formation of hydrates and (2) dispersing oil or gas. The injection points may be located below the mandrel, below the stab point, but may be as high as the upper annular BOP. The injection points may be, for example, on the BOP or LMRP, kill line, etc.

Figure 3A:
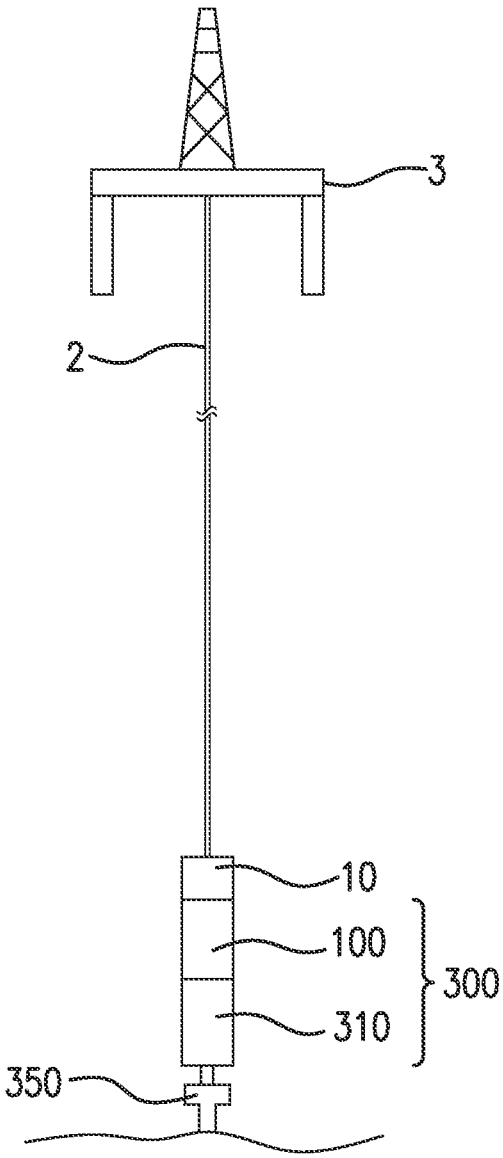
FIG. 3A is an illustration of a subsea drilling system, including a mobile offshore drilling unit, a marine drilling riser, an RDP, LMRP, BOP lower stack, and wellhead, according to embodiments of the invention.
Figure 3B:
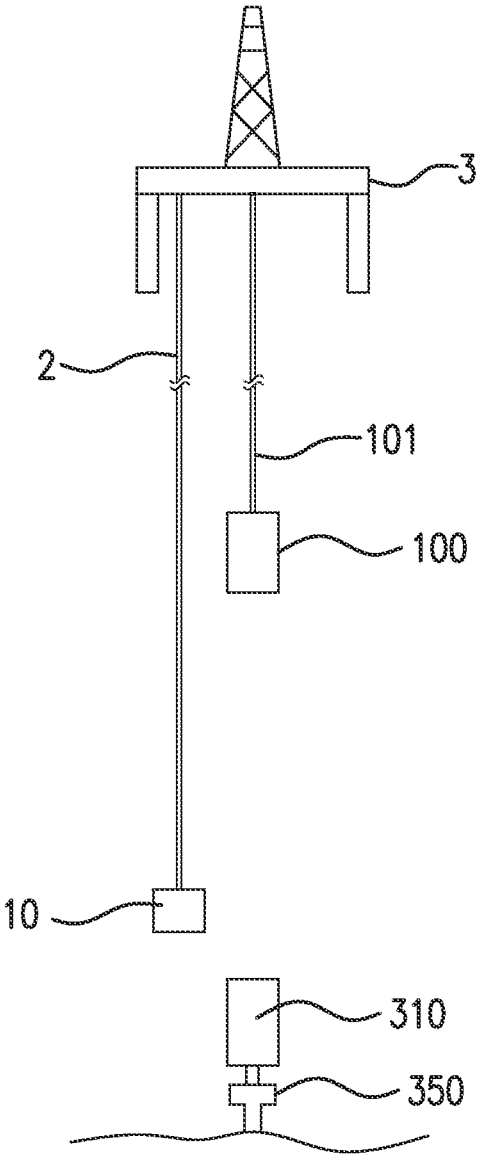
FIG. 3B is an illustration of the subsea drilling system of FIG. 3A, where the RDP has been disconnected from the LMRP and the LMRP has been disconnected from the lower BOP stacks for quick recovery of the LMRP to the surface without the need to recover the MDR, in accordance with embodiments of the invention.

FIGS. 3A and 3B illustrate operation of the RDP and modified LMRP in accordance to one embodiment of the invention. Marine drilling riser (MDR) 2 connects a mobile offshore drilling unit (MODU) 3 to subsea wellhead 350 via RDP 10—LMRP 100—lower BOP stack 310. When required, for example, to control or contain the well in an emergency event or during routine maintenance operations, and as shown in FIG. 3B, the RDP 10 may be disconnected from the LMRP 100 and moved away from wellhead 350 and the BOP stack 310 while suspended from the rig. One of skill in the art will appreciate that MDR 2 can be suspended from MODU 3 in various ways (e.g., via a cart system beneath the drill floor or from an auxiliary well center) depending upon design and structure of a particular vessel. Unlike customary prior art practices, the MDR need not be pulled up to the floating drill vessel. This significantly saves time and money and reduces the danger to personnel on the rig. The LMRP, or the complete BOP stack 300 (excluding the RDP), may be retrieved for repair, maintenance or replacement using a retrieval string made up of the rig's drillpipe 101 (not drawn to scale) or through, for example, an auxiliary winch system (not shown). The drill pipe string can be made-up and tripped much faster than the MDR and an auxiliary winch could recover the components much faster than the drill pipe method. Once the LMRP or entire BOP stack 300 have been removed, various options for re-entry/recovery of control are possible. Containment of the well may also be performed according to various options. Some such options are described in U.S. patent application Ser. No. 13/168,308, filed on Jun. 24, 2011 (published on Jun. 28, 2012 as U.S. Patent Application Publication No. 2012/0160509), the entirety of which is hereby incorporated herein by reference.

Figure 4:
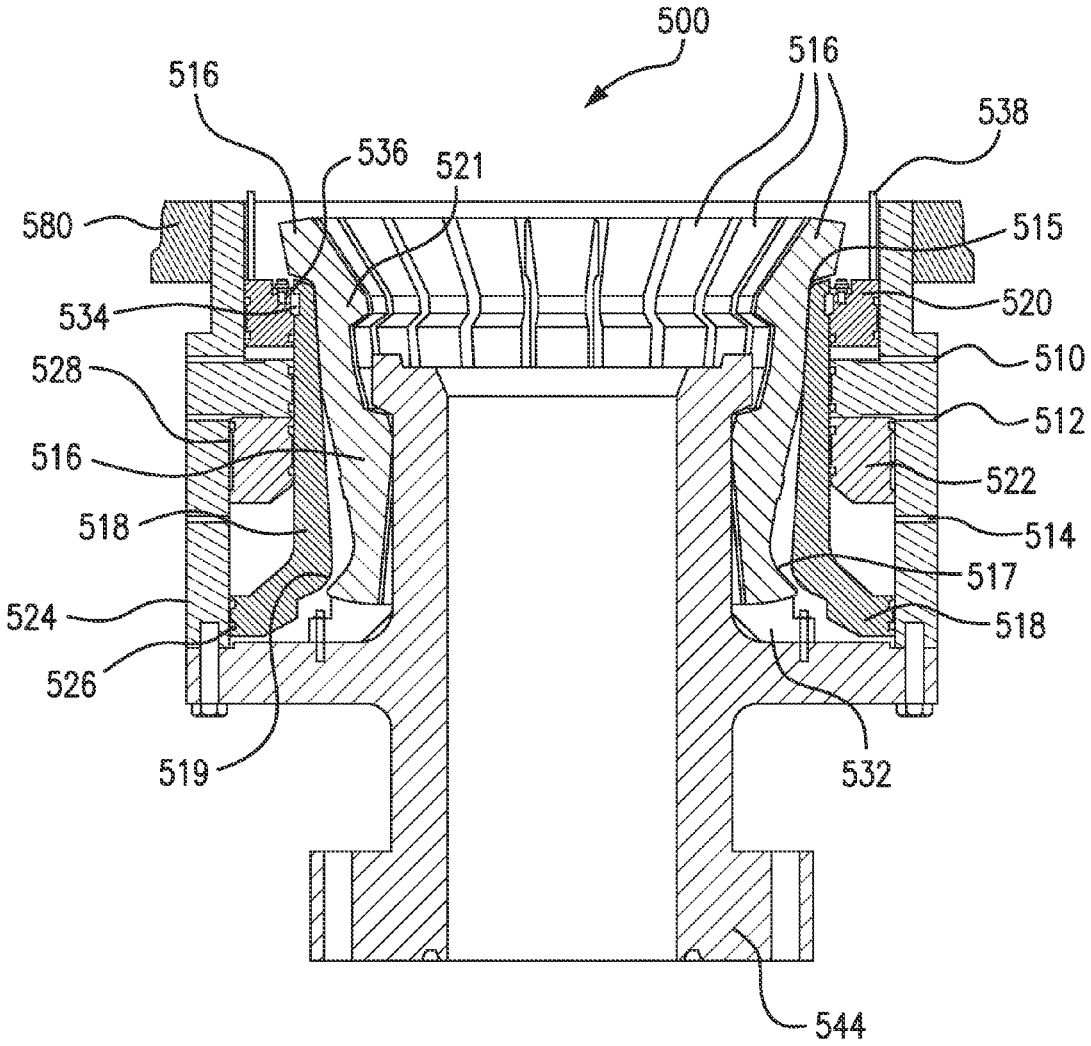
FIG. 4 depicts a connector according to embodiments of the current invention that may be used in a standard, funnel down or in an inverted funnel up (shown) configuration.

One aspect of the present invention and a feature of the RDP of the present invention is the stand-alone hydraulically-actuated, positive unlock, release connector 500, of the "rotating segment" design, shown in FIG. 4. Unlike currently available connectors, connector 500 may be used in a standard (funnel down) or in an inverted (funnel up) configuration as shown in FIG. 4. Connector 500 may be used, for example, to couple a flex joint to an upper annular BOP on an LMRP and/or to join a lower annular BOP to a lower BOP stack (shown in FIG. 18B), or to couple a lower BOP stack to a wellhead. Connector 500 is disconnected by the releasing of the pressure seals and rotating the segments out of engagement with the corresponding mandrel using hydraulic power. The release connector 500 of the current invention permits, for example, the quick and easy coupling and uncoupling of the RDP of the current invention from a LMRP, and/or an annular BOP from a lower BOP stack. As shown in FIG. 4, connector 500 comprises various components including gripping members or segments 516 having a hook 517 and a lock end 515 on the opposite end. Lock end 515 has a geometrical shape designed to match the profile of a mandrel. Each segment rotationally pivots between a lock and unlock position. In the locked position, the segments clamp around a mandrel (not shown in FIG. 4). In the unlocked configuration the lock end of the segments form an internal guide funnel shape that assists in landing the connector on the mandrel or, in an inverted scenario, the mandrel into the connector. Each segment is in contact with actuator piston ring 518 that pivots the segments between a locked and unlocked position as piston 518 moves relative to and along the outer surface of the segments. Adjacent to and connected to actuator piston 518 is actuator piston head 520. Secondary unlock piston 522 is also adjacent to actuator piston 518 Connector 500 also comprises ports, 510, 512 and 514 located within operating cylinder 524. Port 510 is a hydraulic lock port, port 514 is a hydraulic unlock port and port 512, is a secondary unlock port. As shown in FIG. 4, an upper piston chamber is formed above lock port 510 between piston 518 and piston head 520 and a lower piston chamber is formed between piston 518 and secondary piston 522, the lower chamber being in hydraulic communication with ports 512 and 514.

Figure 9A:
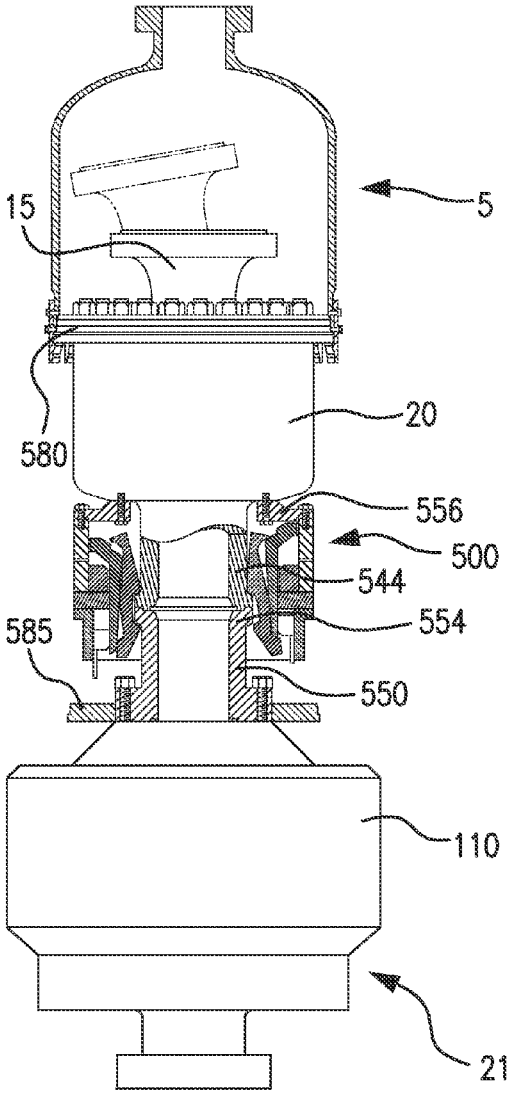
FIG. 9A depicts an embodiment of the disconnect/reconnect Flexconn S assembly of the current invention.

In operation, when hydraulic pressure is applied to the unlock port 514, or secondary unlock port 512, the actuator piston 518 is driven via pressure applied to the extension proximate to cylinder 524 toward the unlock position as shown on the right hand side of FIG. 9A, contacting the unlock end of segments 516, and rotating the segments out of engagement with the mandrel hub 550. In the connector of the present invention, as the actuator ring 518 strokes further and the segments 516 rotate out of contact with the mandrel hub 550, the contact between the actuator ring/piston 518 and segments 516 shifts to a more axial direction resulting in a faster segment rotation. Once the segments have rotated to the fully open position, the connector may be lifted from mandrel 550. The secondary piston strokes in the unlock direction if pressure is applied to the secondary unlock port. Having applied pressure to the secondary unlock port, when the connector is then locked, the secondary piston returns to its starting position.

Less release force is required to disengage or unlock connector 500 of the current invention than prior art connectors. Besides hydraulic pressure applied to the unlock port(s), no other applied force is required to disengage the connector from the mandrel. The design of the actuator piston 518 is such that an axial force would be possible to push the piston up segment 516. Segment hook 517 and piston knuckle 519 are designed differently than the prior art and this modification results in a higher initial radial force at the top of the segment right "above" knuckle 519 in both the standard funnel down or inverted funnel up configurations.

As shown in FIG. 4 connector 500 also comprises saddle 532 that is situated either below (inverted configuration) or above (in standard configuration) segment 516 and actuator piston head 520. Saddle 532 allows the standalone connector assembly be designed to function in both the funnel up (inverted) and funnel down (standard) orientation. No modification is required to the stand alone connector assembly to accomplish this. A saddle may be present but is not needed in the standard funnel down configuration. In some situations or applications it may be desirable to operate with the connector in one particular orientation. As detailed below, in some embodiments of the current invention when the connector is in the inverted position such as in the Flexconn I assembly of FIG. 13 for example, it is easier and less time-consuming to reconnect the flex joint with the integrated mandrel to the connector than it would be in the standard connector down configuration. This inverted orientation of connector 500 also reduces the likelihood of hydrate build up in segments 516 or other components which could prevent the normal operation of the lock sequence while connecting a capping stack or other well containment device in the presence of controlled or uncontrolled well flow. Saddle 532 bolts to center body 544 [shown in FIGS. 10A and 10B]. However, it is recognized that any method of connecting the saddle with center body 544 or having the saddle as an integral part of the center body is also within the scope of the invention.

To lock the connector to the profile of the mandrel, hydraulic pressure is applied via port 510, thereby generating a force to piston head 520. The pressure will eventually cause piston head 520 to move from the unlocked position, shown in FIG. 4, to the locked position as shown, for example on the left hand side of FIG. 10A. As piston head 520 moves away from port 510, actuator ring 518 moves along the tapered outer surface of segments 516 proximate to lock end 515, thereby rotationally pivoting the segments inwardly until the inner locking profile 521 of the segments capture and engage the mandrel profile. When stroked to the locked position, the locking profile of the segments provide a sealing force to the mandrel profile as shown in the left hand side of FIG. 10A, for example.

Figure 10A:
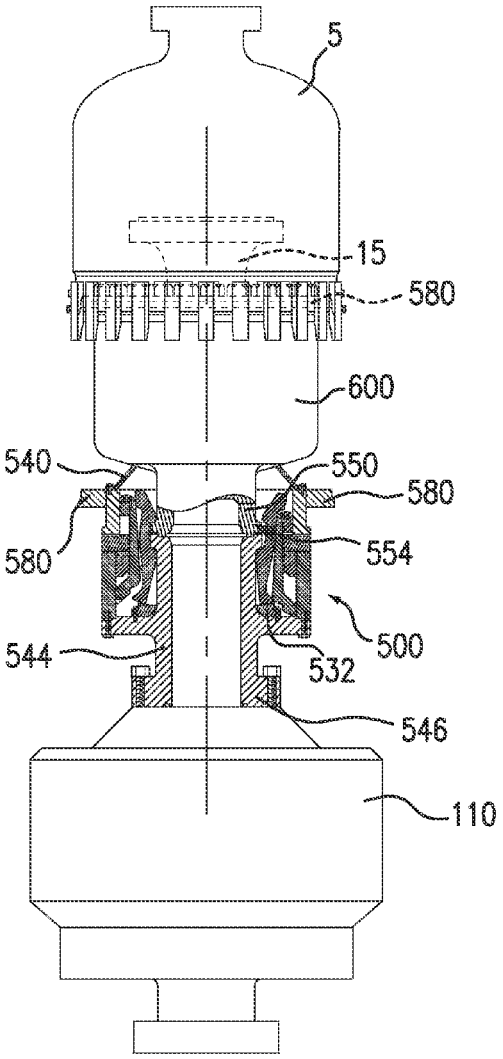
FIG. 10A depicts an embodiment of the disconnect/reconnect Flexconn I assembly of the current invention.
Figure 10B:
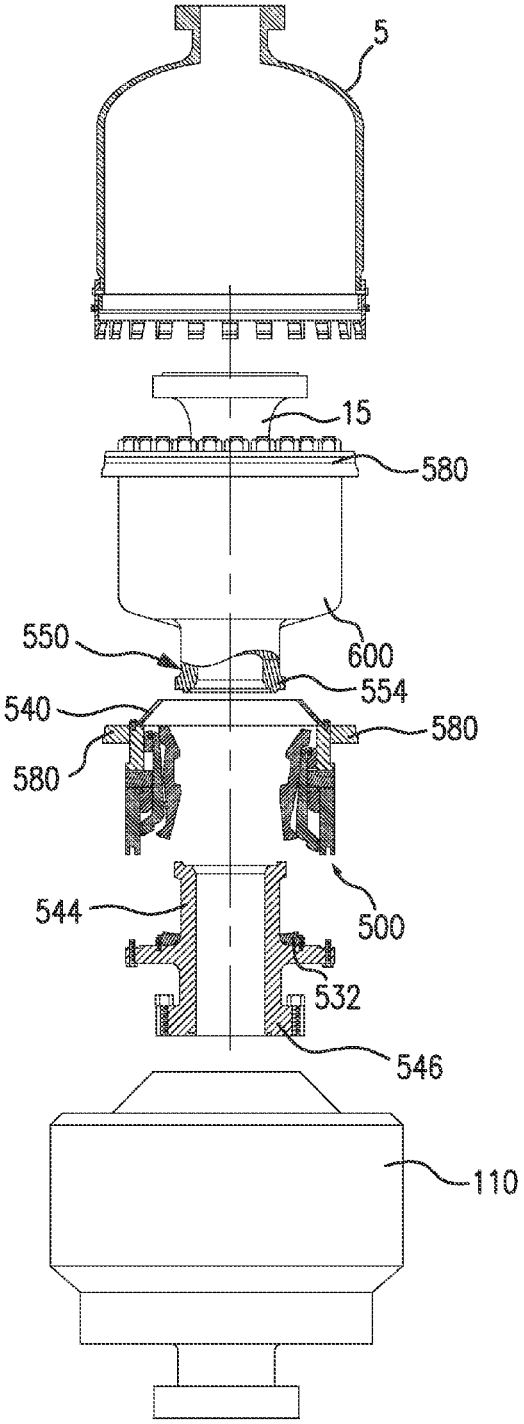
FIG. 10B is an exploded view of the assembly of FIG. 10A.

Position indicator 538, shown in FIG. 4, and debris excluder 540 shown in FIGS. 10A and 10B are additional elements that may be included with the connector. Position indicator 538 provides a visual indicator to the ROV of whether the connector is in the locked position (i.e. indicator 538 exposed) or the unlocked position. Debris excluder 540 is preferably present when the connector is used in the inverted configuration to prevent material from falling into the connector during well operation. Other components of the connector such as operating cylinder 524, a plurality of seals 526 along the inner surface of cylinder 524 and the outer surface of actuator piston ring 518 to create piston chambers, bearing 528, and lock ring 534 are standard elements of connectors well recognized by a person of skill in the art.

Figure 5A:
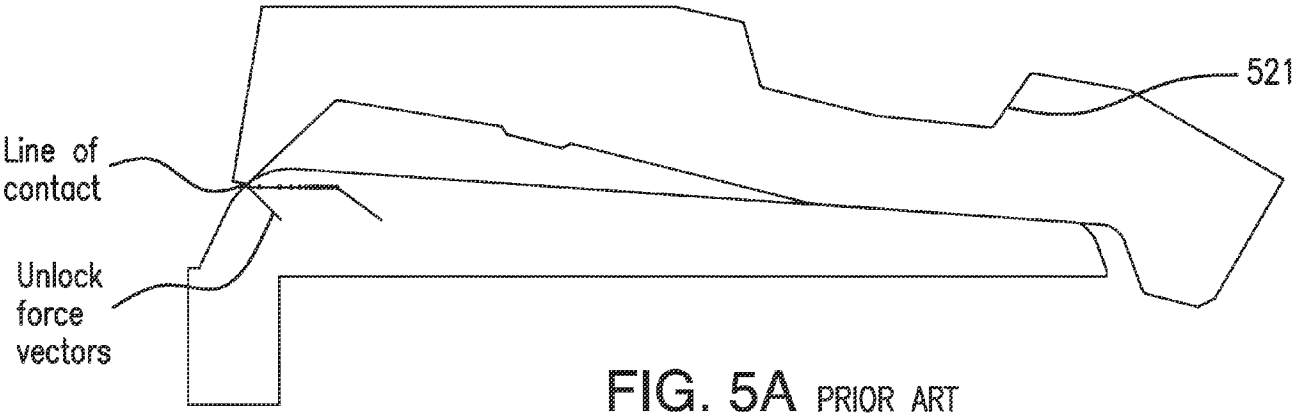
FIG. 5A PRIOR ART
FIG. 5A depicts a piston and locking segment as in a prior art connector.
Figure 5B:
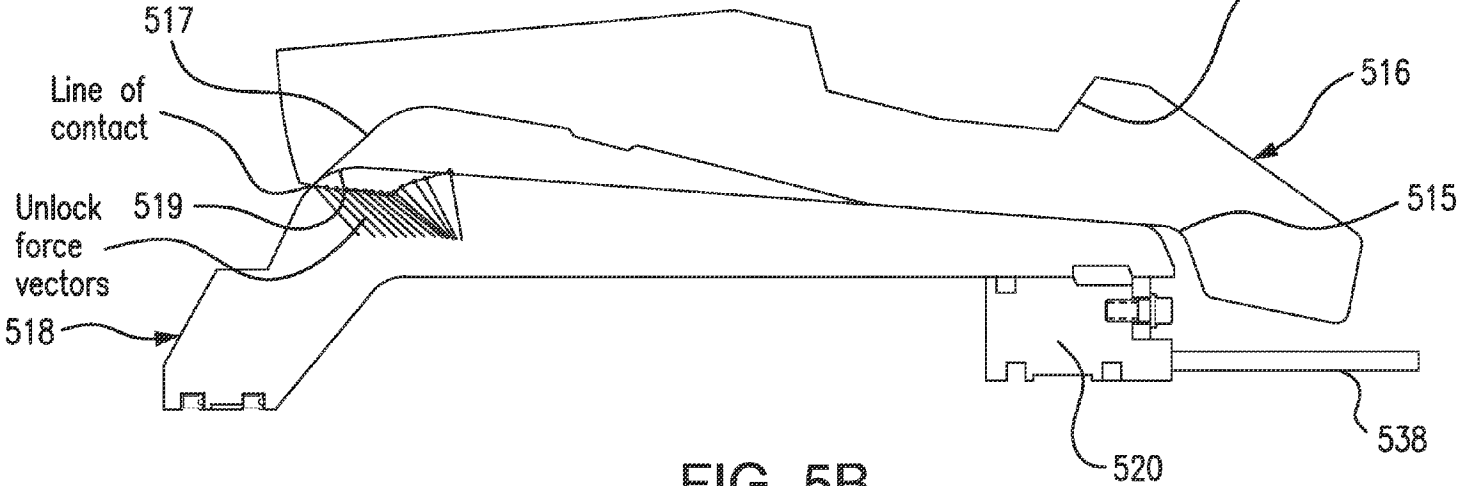
FIG. 5B—depicts a locking segment and an actuator piston of the modified connector of the present invention. Both

FIG. 5A depicts a piston and locking segment as in a prior art connector. FIG. 5B-depicts a locking segment and an actuator piston of the modified connector of the present invention. FIGS. 5A and 5B illustrate the geometrical or structural differences between prior art connector components and those of the present invention including lines of contact and unlock force vectors. The action involved in the rotating, or unlocking, of the segments is basically a "cam" action as typically achieved with eccentric, oval or offset circular discs or surfaces. In the case of the present connector, there are two offset circular surfaces with an ever-changing offset (by virtue of the stroking of the actuator piston). Existing connectors, consist of a taper on the actuator piston acting against a tapered segment surface. This combination results in a linear rate of rotation and a linear force to rotate the segment. For example, the usual initial angle of contact on the segment is approximately 40-45 degrees. This angle constantly changes as the segment rotates, however, the force remains constant. The piston and segments of the modified connector of the current invention have radiused contact surfaces. In one embodiment of the invention, by way of example, the radius on the actuator piston is approximately 2.5 inches, while the radius on the segments is approximately 2.0 inches. A person of skill in the art would recognize that this is just an example and other radii measures should also work. In reference to FIGS. 5A and 5B, prior art, FIG. 5A shows a relatively constant force while FIG. 5B shows an initial greater contact force that gradually decreases as the actuator piston strokes for the components of the present invention. Also regarding FIG. 5B, the load applied to the unlock end of the segment by piston 518 is predominantly radial in direction resulting in a high initial force to rotate the segments from engagement with the mandrel hub. This higher initial radial force on the segments assists unlocking even in the presence of external lateral or axial loads at the time of unlocking.

Figure 6A:
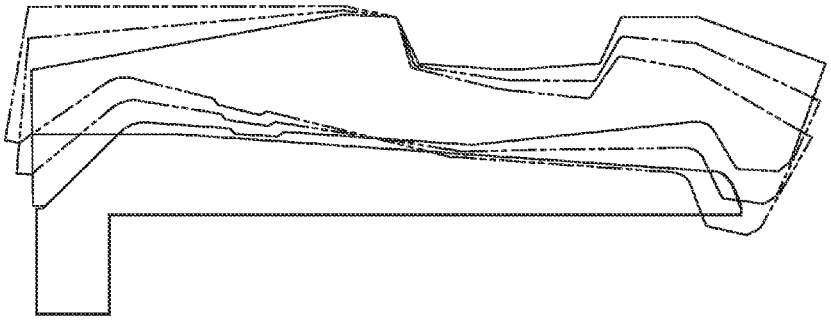
FIG. 6A PRIOR ART
FIG. 6A shows a piston and locking segment of a prior art connector in initial, mid and full stroke positions.
Figure 6B:
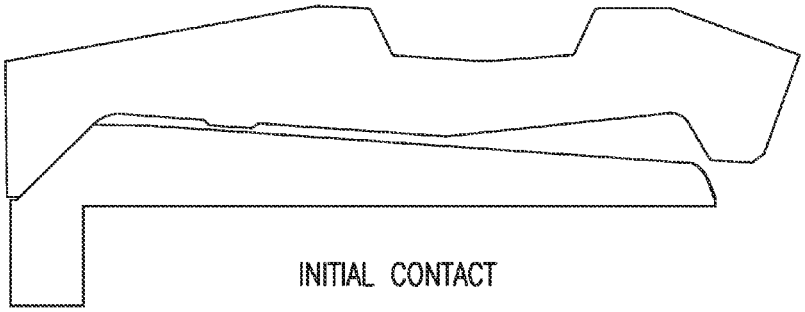
FIG. 6B PRIOR ART
FIG. 6B depicts the initial contact position between the piston and the locking segment of FIG. 6A. Similarly, FIG. 6C separately shows a mid-stroke configuration
Figure 6C:
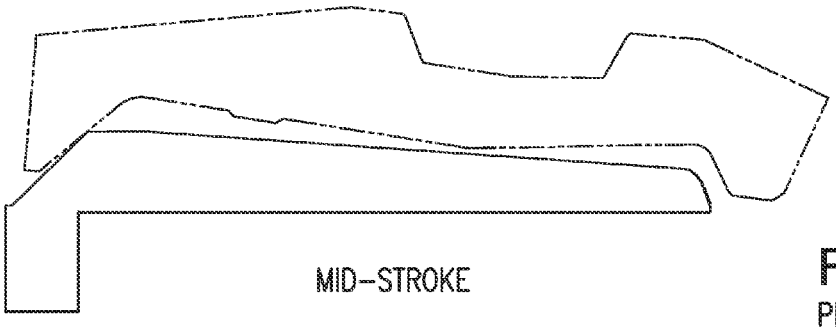
FIG. 6C PRIOR ART
FIG. 6D illustrates the piston and locking segment during full stroke (the unlocked position).
FIG. 6E (prior art) and FIG. 6F illustrate the greater initial radial force on the locking segments by the piston of the current invention.
FIGS. 6G-6J show piston and locking segment, in initial, mid and full stroke positions, of a modified connector in accordance with the current invention.
Figure 6D:
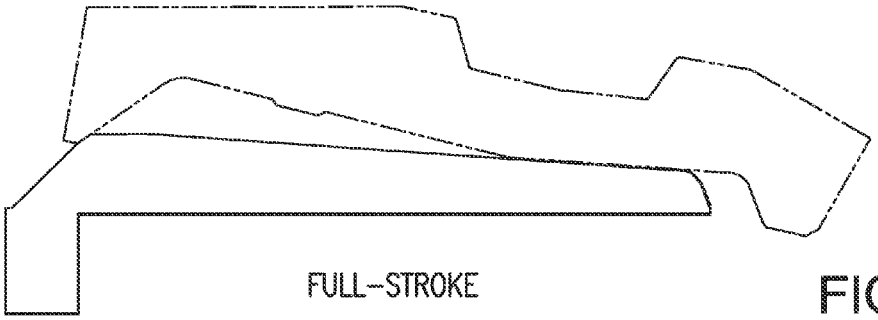
FIG. 6D PRIOR ART
Figure 6E:
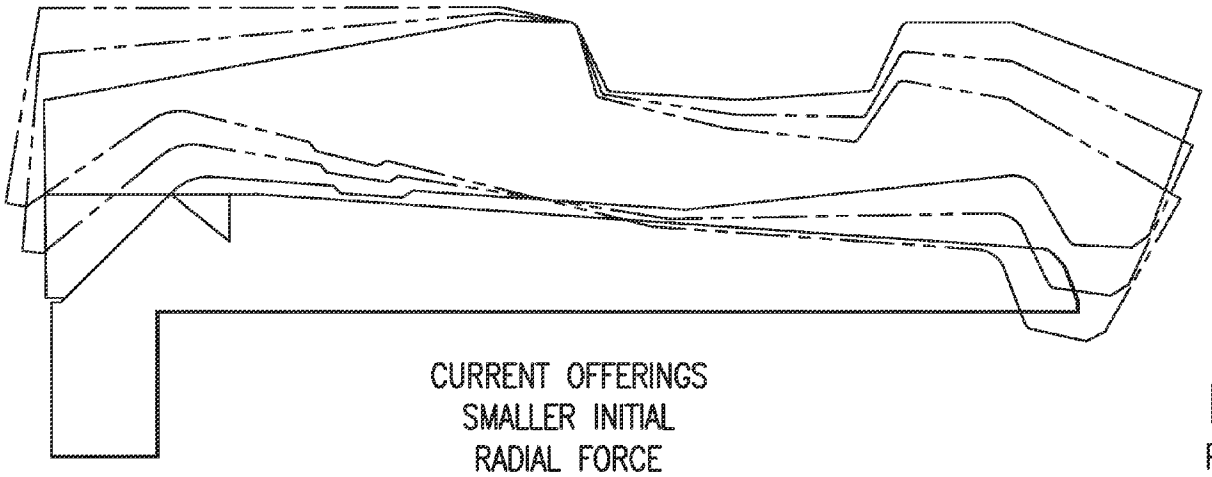
FIG. 6E PRIOR ART
Figure 6F:
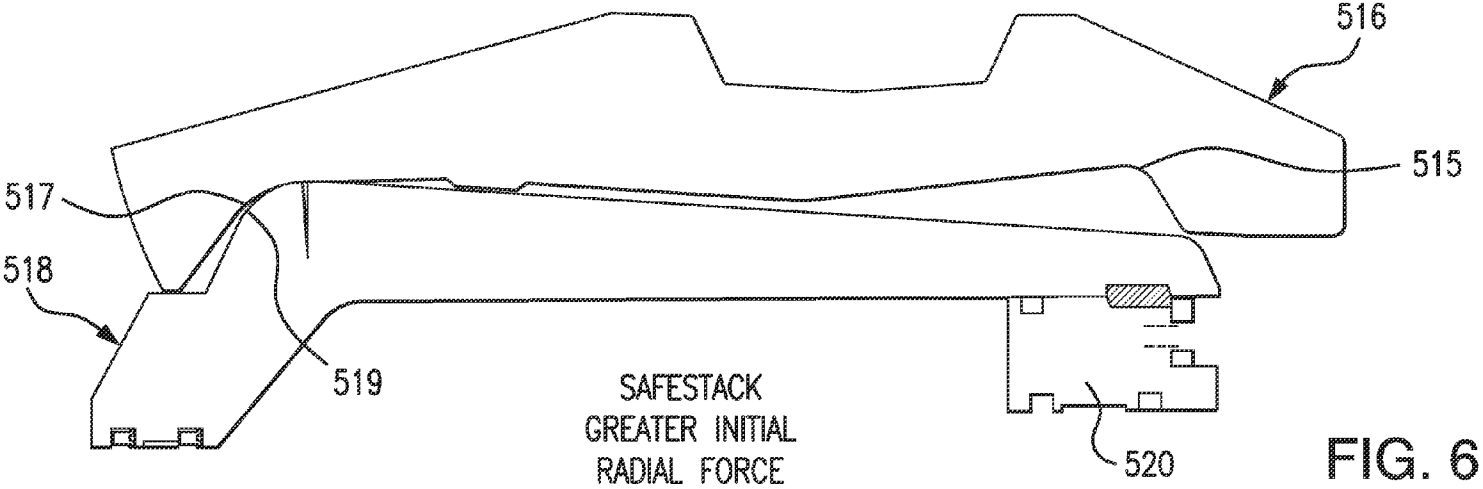
Figure 6G:
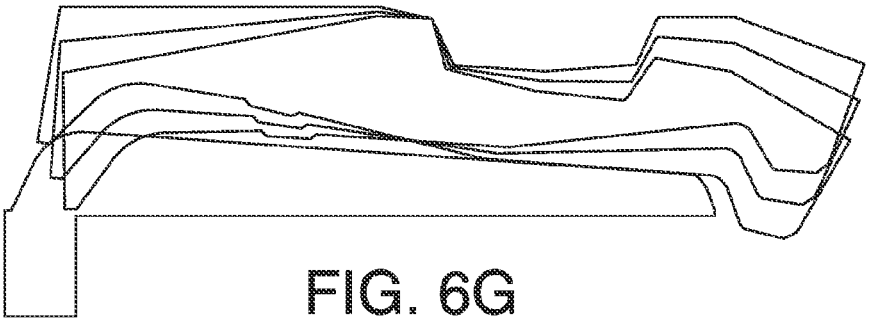
Figure 6H:
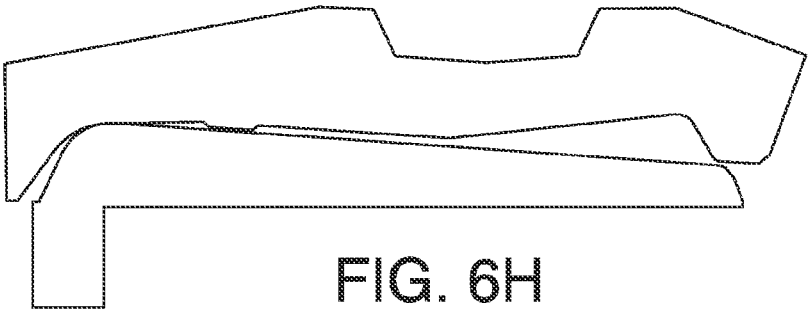
Figure 6I:
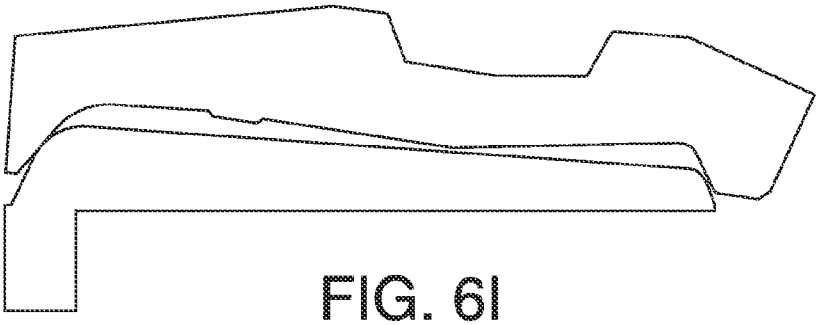
Figure 6J:
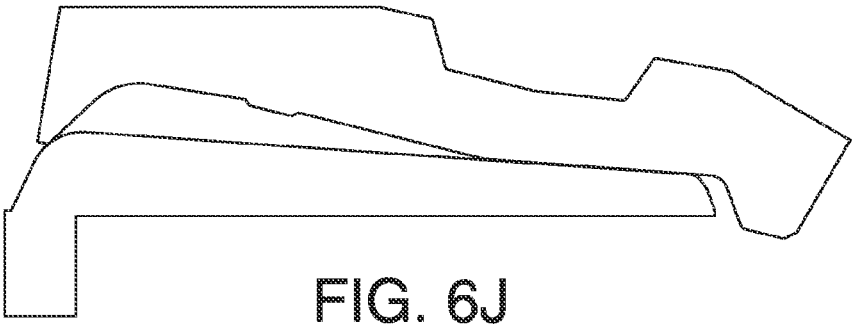

A piston and a locking segment of prior art connectors in initial, mid and full stroke positions are illustrated in FIGS. 6A to 6E. FIG. 6F illustrate that in the connector of the present invention, the locking segments are subject to a greater initial radial force by the piston as compared to the prior art. No other applied force is required to disengage the connector from its mandrel. The greater initial radial force assists in unlocking the connector even when external lateral or axial loads are present at the time of unlocking.

Figure 7:
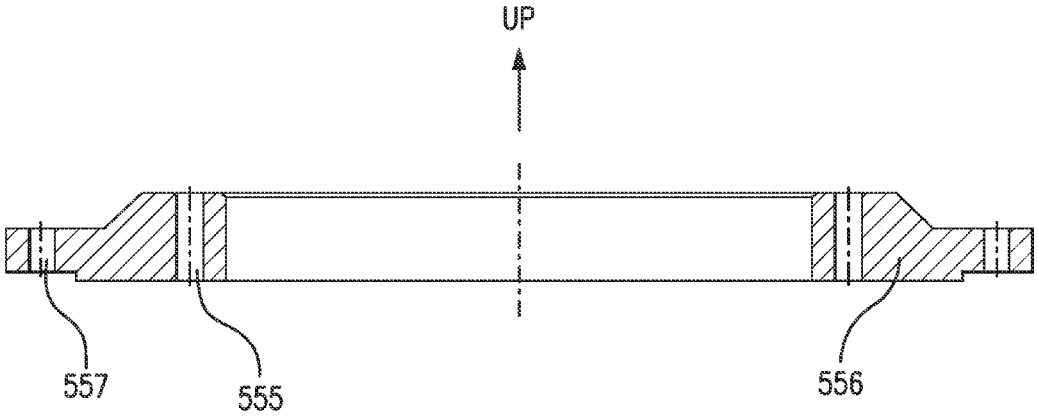
FIG. 7 is a side view of an adaptor plate or adapter flange 556 that is used in a standard FlexConn S assembly of the current invention.

Release connector 500 may also include an adapter flange 556, (shown in FIGS. 7 and 11A) which may be used to bolt connector 500 to the lower part of flex joint 20, in the Flexconn S assembly. As depicted in FIG. 7, the adapter flange 556, bolts to the lower end of the flex joint using bolt holes 555 as shown and to the connector by means of bolt holes 557. The adapter flange 556 can also be modified and used to connect an annular to the release connector. The release connector in accordance with the current invention can also be integrated into the flex joint and/or to the top plate of the lower annular of a subsea stack. Various configurations of subsea stacks are within the scope of the present invention and will be discussed in details hereafter.

Release connector 500 may also be provided with large latch/seal plate 580 to effect the attachment of a containment dome as depicted in FIGS. 12A, 12B, 13, 15, 19A and 19B. A mandrel 559 or 560 may be provided with the smaller latch/seal plate 585 to effect the attachment of a small containment dome or mechanical locking connector 400 as depicted in FIG. 22. Latch/seal plate 580 is shown in FIGS. 20A and 20B. In accordance with the current invention, latch/seal plates 580 and 585 may be provided at various sites within a subsea assembly and in association with different components. For example seal plate 580, may be integrated with flex joint 20 or flex joint 600 as shown in FIG. 9A through FIGS. 16 and 18A-19B, and the smaller latch/seal plate 585 may be integrated with mandrel 559 as in FIG. 8B, or with mandrel 560 as in FIG. 8C.

Figure 8A:
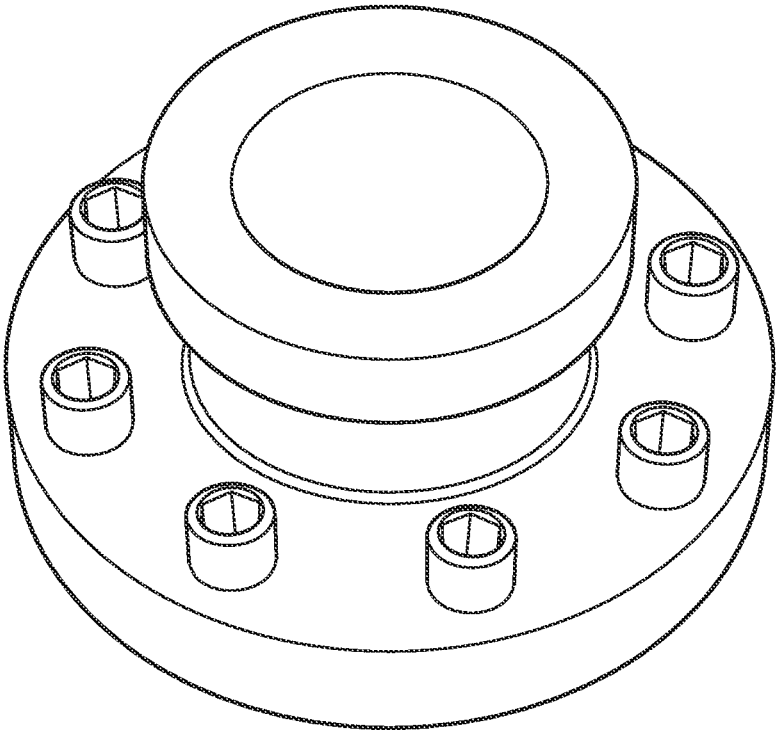
FIG. 8A PRIOR ART
FIG. 8A illustrates a prior art mandrel.
Figure 8B:
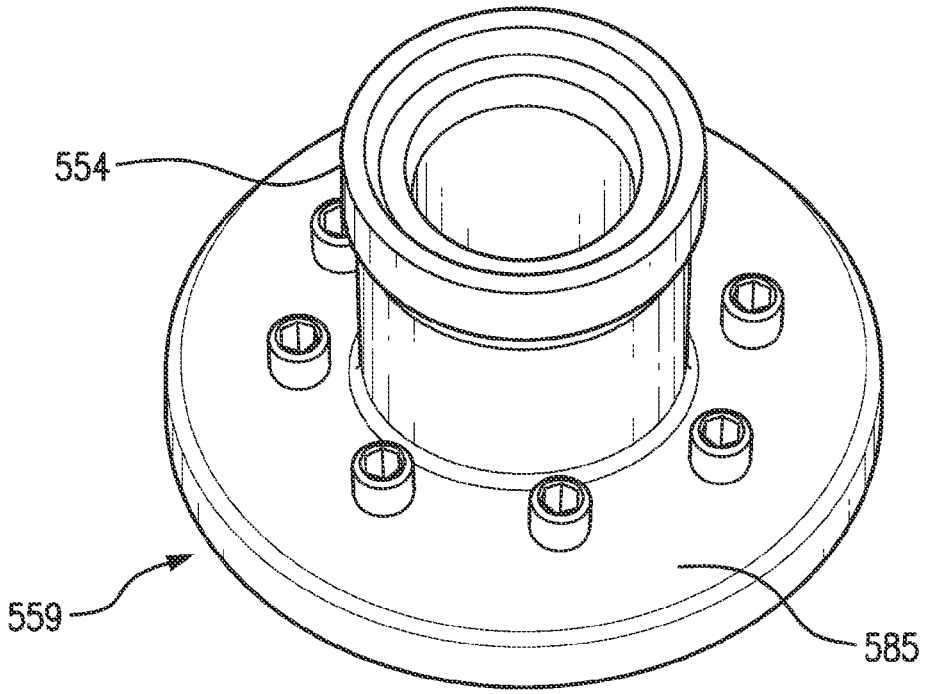
FIG. 8B depicts an isometric view of a mandrel in accordance with an embodiment of the current invention.
Figure 8C:
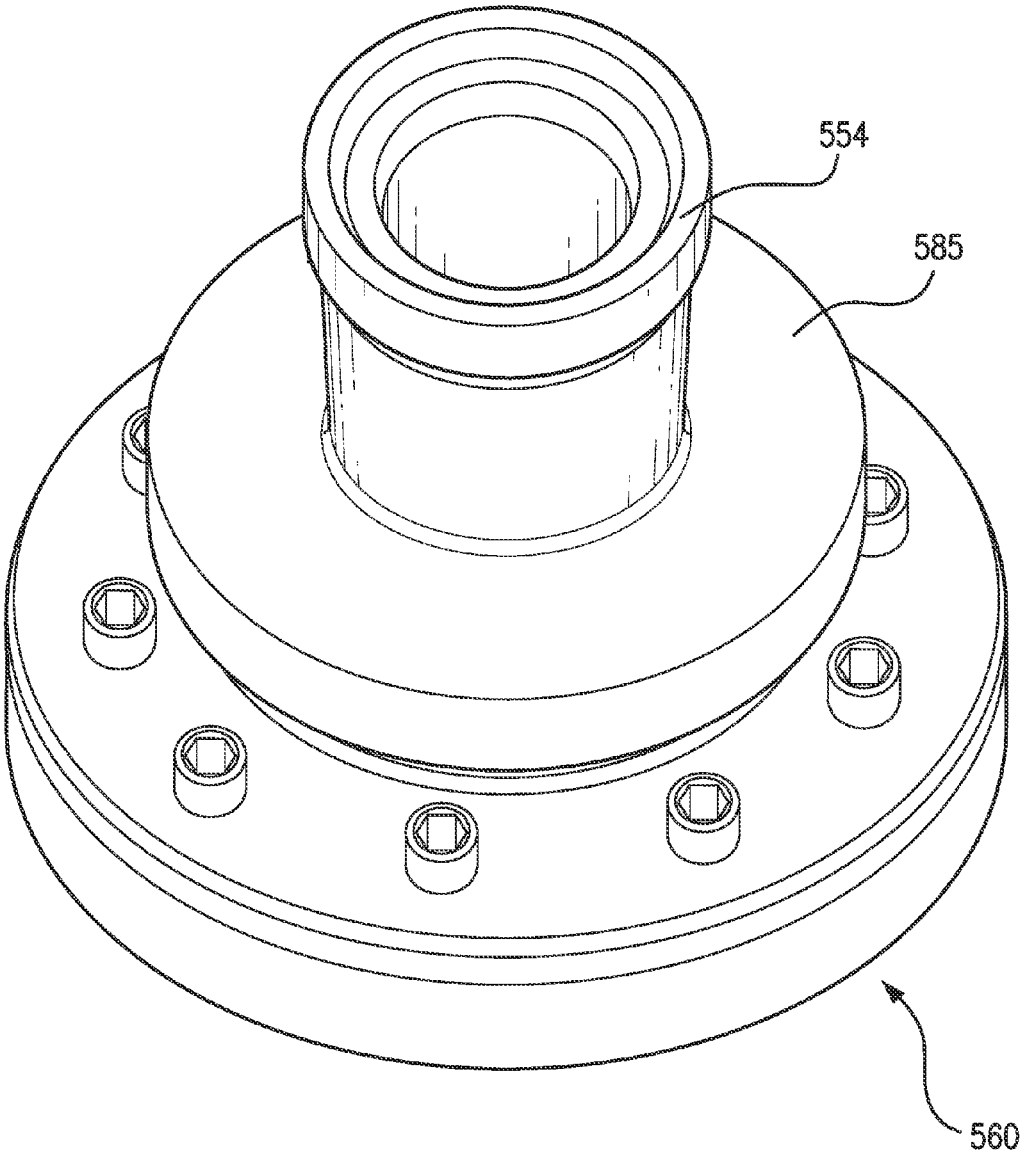
FIG. 8C an isometric view of a mandrel in accordance with an alternative embodiment of the current invention.

The connector mandrels in accordance with the current invention, are modified from the prior art mandrels (shown in FIG. 8A) and may be incorporated into a subsea assembly by bolting via a flange (to a flex joint, an annular or to the top of the lower BOP stack for example). Alternatively the mandrels may be formed as an integral part of a flex joint, or an integral part of the top plate of the uppermost annular BOP. i.e. built as one piece with the annular as discussed hereafter in relation to various embodiments. This latter scenario has the advantage of lowering the height of the stack, e.g., by approximately one foot, and reducing wherever possible the number of flanged connections and potential leak paths in the BOP assembly. Referring to FIG. 8B, depicted is a design for a mandrel 559 with profile 554 and latch/seal plate 585 configured to be installed on top of a lower BOP stack to effect the use of a small containment dome or MLC 400. Mandrel design 560, depicted in FIG. 8C, is used as an integral part of the top plate of an annular BOP.

Figure 9B:
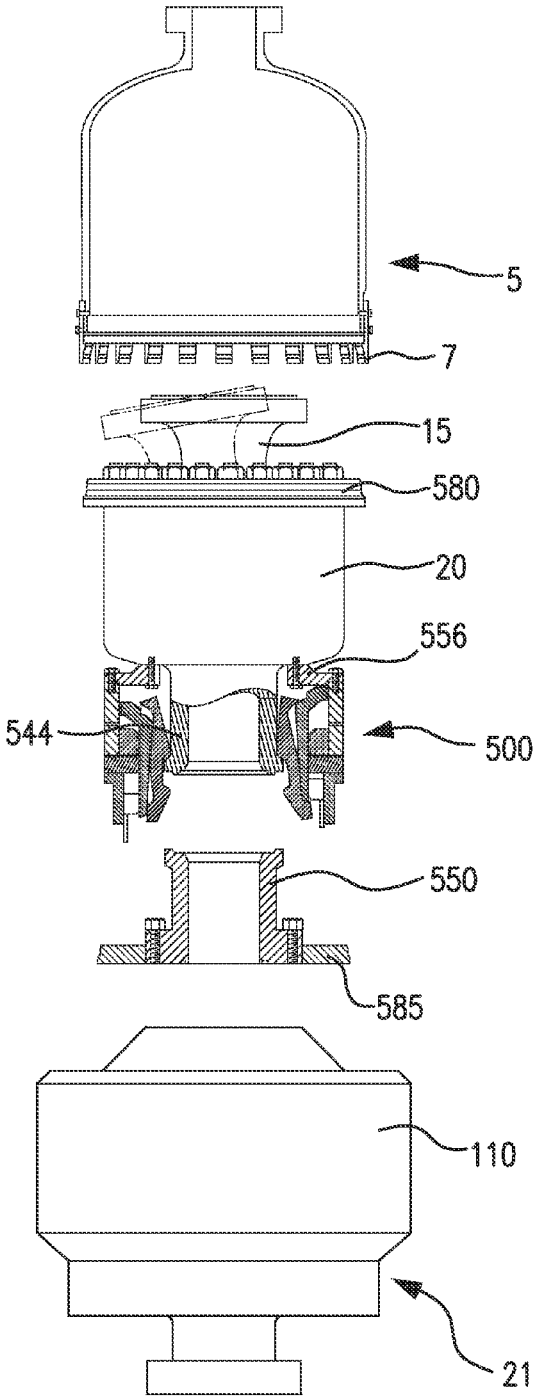
FIG. 9B is an exploded view showing the various components of the assembly of FIG. 9A.

The flex joint of the current invention has a seal plate to effect the attachment of a dome or a mechanical locking connector when the well needs to be contained and either the body center section of a release connector (in a standard Flexconn S configuration 20) or a mandrel profile for a release connector (in the inverted Flexconn I assembly 600). The body of the flex joint is further modified in a standard Flexconn S configuration, as shown in FIGS. 9A and 9B for example, to accept attachment of the connector via a top plate/adaptor flange 556.

The current invention provides for configurations of a flex joint—connector assembly in a standard or in an inverted format. A commercially-available flex joint may be used in a Flexconn of the current invention. FIGS. 9A and 9B illustrate a Flexconn S assembly in which connector 500 is in a standard orientation and its corresponding mandrel 550 is bolted to top annular 110. Flex joint 20 include riser interface 15 for connection to an MDR. The flex joint is modified, in accordance with the current invention, to have latch/seal plate 580 so as to effect attachment of dome 5 if needed. Flex joint 20 is attached at its lower end to release connector 500 via adapter flange 556. Although in this embodiment, the Flexconn S assembly is designed to include an adapter flange, the Flexconn can be built from one forging of a flex joint and connector so as to produce an integrated system. Release connector 500 is adapted to engage mandrel 550 having a profile 554 and latch/seal plate 585, an alternative latching option for containment dome 5 or MLC 400 In this example of a subsea stack, mandrel 550 is bolted to the top plate of annular 110. FIG. 9B is an exploded view showing the various components of the assembly of FIG. 9A for illustrative purposes. When disconnected, the Flexconn S subassembly comes off as a single unit.

Figure 9C:
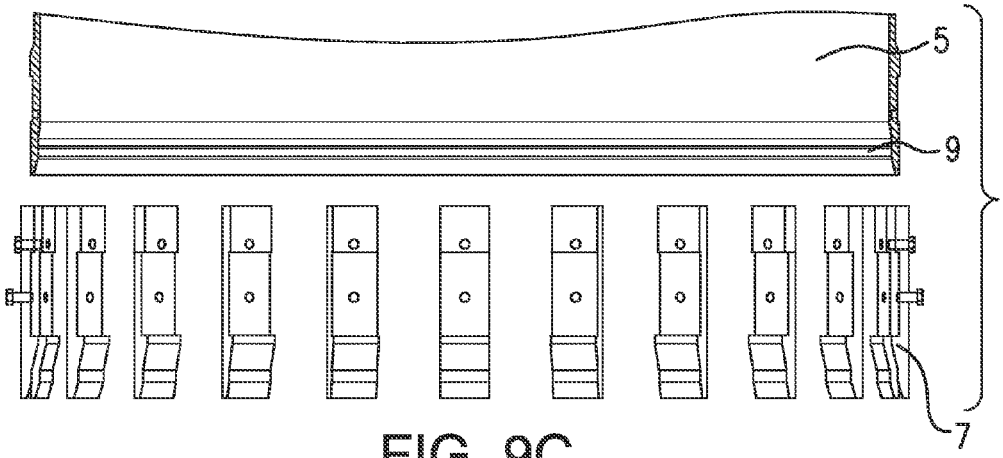
FIG. 9C depicts an exploded view of a section of the containment dome with its latch lock and spring latches in accordance with the current invention.
Figure 9D:
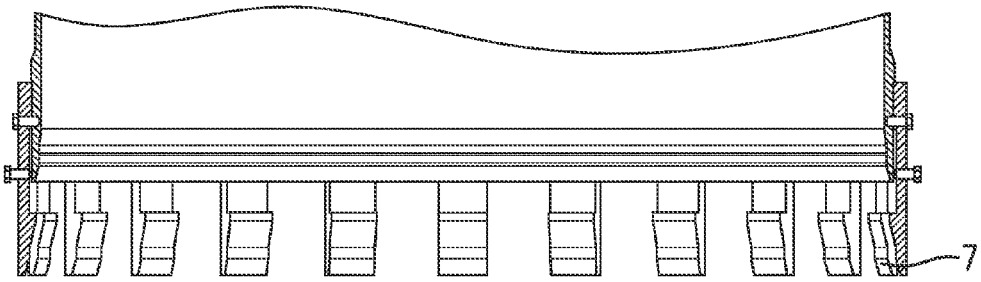
FIG. 9D illustrates the various components of 9C assembled.
Figure 9E:
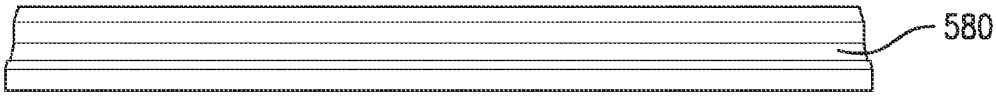
FIG. 9E depicts an example of a latch/seal plate that is configured to mate with the latch lock and the spring latches on the containment dome and the MLC.
Figure 9F:
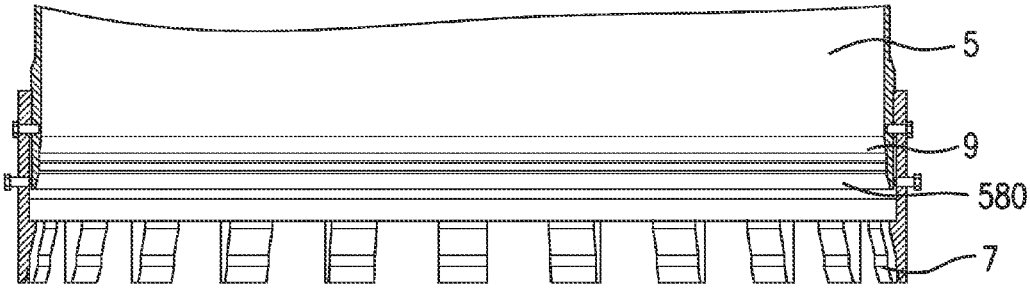
FIG. 9F is an assembled view of the dome section with the latch lock, spring latches and the seal plate.

FIG. 9C to 9F depict exploded views of a section of the dome with its latch lock 9, spring latches 7 and latch/seal plate 580 that is integrated into the dome in the containment position (FIG. 9F). Latch/seal plate 580 includes an external mating profile that is compatible with the internal profile of latch lock 9. Latch/seal plate 580 may include O-ring seals or suitable compliant seals or may be configured to create a metal to metal seal when latched into latch lock 9, as understood by those skilled in the art. The dome latch consists of a number of cantilever beams, or springs, arrayed around and attached to the lower end of the dome. As illustrated in FIGS. 9C and 9D, the springs are attached by the upper bolt. The dome latch mechanism is a weight set design. As the dome is lowered, the springs contact a lead-in taper on the latch plate and the weight of the dome and attached flow line spreads the springs radially outward. As the dome is lowered further the springs pass over and spring radially inward over a latching shoulder on the latch plate. The contact of the springs with the latch plate shoulder retains the dome in place. The lower end of the dome contains elastomer seals that engage a seal surface on the latch plate. Removal of the dome is achieved by rotating a jack screw (shown in the extended position in FIG. 9F) in each spring which forces the spring radially outward at the latching shoulder disengaging the shoulder. The dome may then be lifted from the latch plate. In design, the length, width, thickness and material of the springs may be adjusted to suit the loads and pressures that are expected to be retained by the latch. The containment dome may contain one or more ports (not shown) for connecting flow lines for diverting the flow of wellbore fluids to seabed manifolds or directly to the surface or for the injection of kill or containment fluids into the well. The system in accordance with the current invention utilizes two different sized latch/seal plates and containment domes. The larger latch/seal plate 580 is installed on a connector 500 or flex joint 20 or 600 and accommodates the connection of the large containment dome 5. The smaller latch/seal plate 585 is utilized in conjunction with a mandrel 559 or 560 and accommodates the connection of the small containment dome 6 or a mechanical locking connector/adapter 750. It is noted that although the system utilizes two sizes of latch/seal plates and containment domes, both are designed identically other than being sized for their specific application in the system.

Annular BOPs can be prior art annulars known to a person of skill in the art or annulars modified in accordance with the current invention. The modified annular in accordance with the current invention have integrated release connectors or connector mandrels and/or a latch/seal plate as will be described below in further details. In alternative embodiments, the center body section of a release connector is integrated into the top plate of an annular.

Annular BOP(s) of the current invention may be modified to provide for containment of higher pressures e.g., 15,000 or 20,000 psi. The modified annular could incorporate a 15,000 psi-rated housing while using 10,000 psi internals/packers found in commercially-available annulars. In this case, all components below the annular BOPs may also be components rated to withstand the same pressure. This configuration will provide a 15,000 psi rating through the entire system from well head to capping stack. Prior art annular BOPs in use today are rated to withstand a maximum working pressure of 10,000 psi so represent a weak link in the pressure rating of the wellbore from wellhead to capping stack.

The annular may also be modified to provide bypass capability or increased bypass orifice (diameter) to permit higher flow rates by means of bypass port 800 to redirect well flow to facilitate the connection of a capping stack, containment dome, MLC 400 or other similar well control/containment apparatus without the impediment of well pressure and flow. Further, the emergency bypass line 800 (see, e.g., FIG. 1) may be provided with orifices having an inner diameter of, e.g., 6-8 inches, as compared to prior art of, e.g., 2.5 to 3 inches. This increased diameter permits greatly increased flow rates.

In reference to FIGS. 10A and 10B, a FlexConn I assembly is provided with connector body center section 544 bolted via flange 546 to the top plate of annular 110. In this embodiment, flange 546 is an integral part of the connector body section. The exploded view of FIG. 10B depicts that connector 500 and body center section 544 are uncoupled. This is for illustrative purposes only. A person of skill in the art recognizes that unlocking connector 500 releases it from mandrel 550 and not from its body center section 544. The RDP in this embodiment is disconnected by uncoupling connector 500 from mandrel 550. Upon disconnection, connector 500 stays with annular 110. Flex joint 600 is modified to comprise a mandrel 550 to couple to connector 500 in an inverted orientation Mandrel 550 has profile 554 which structurally matches the top end of center body section 544 in order to functionally clamp together when connector 500 is in the lock position. Debris excluder 540 on connector 500 protect the inside of the connector from fallen material. Saddles 532 allow the inversion of connector 500 in this embodiment. The piston and locking segments of connector 500 in an unlock position are shown on the right hand side and in the locked position on the left hand side of FIG. 10A. The assembly configuration of FIGS. 10A and 10B has two seal plates 580, one on flex joint 600 and the second on the connector 500, either which can effect the attachment of dome 5 if needed. FIG. 10A also depicts a containment dome that in this configuration of the RDP of the current invention, can latch to either one of two latch/seal plates 580 if needed on either flex joint 600 and or on connector 500.

Figure 11A:
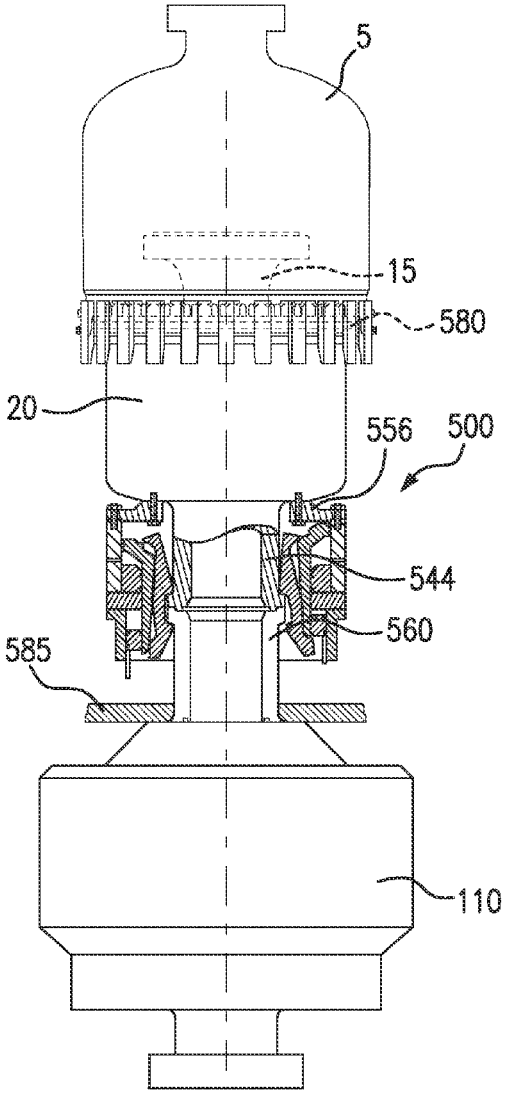
FIG. 11A illustrates a Flexconn S assembly of the current invention.
Figure 11B:
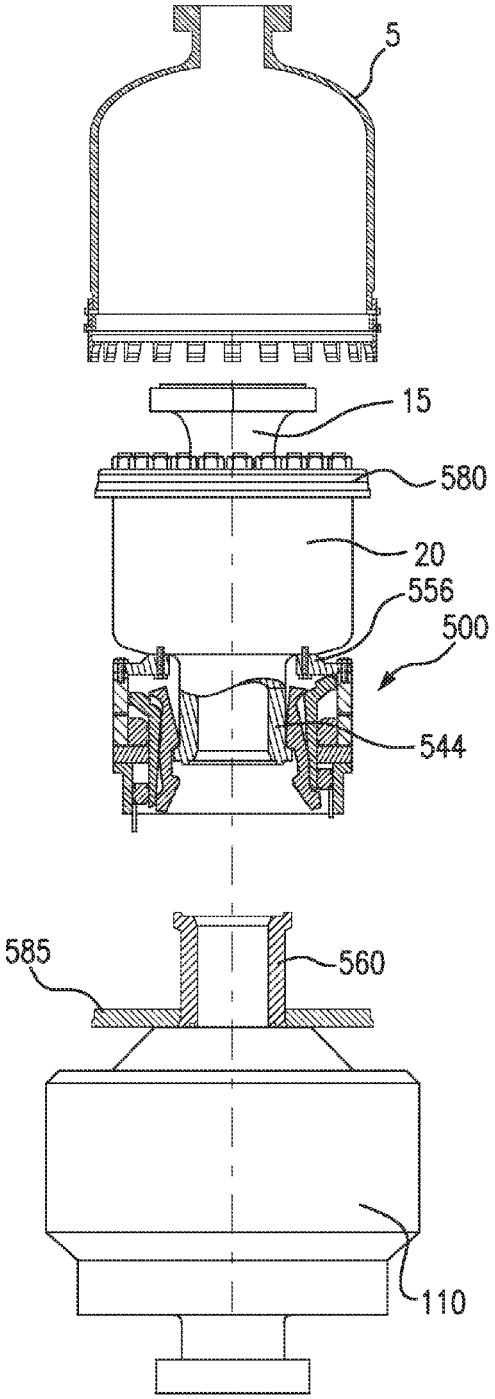
FIG. 11B is an exploded view of FIG. 11A.

FIGS. 11A and 11B illustrate a Flexconn S annular assembly in which the connector mandrel is an integral part of the top plate of the annular. In this configuration, flex joint 20 comprises body center section 544 of release connector 500 and latch/seal plate 580. Release connector 500 is in the standard funnel-down configuration and is attached to flex joint 20 by adapter flange 556. The right hand side of the connector illustrates a piston and locking segment in the unlock position in FIG. 11A. Conversely, the piston and locking segment on the left hand side illustrate the connector in the locked position. Connector 500 engages mandrel 560 which is integrated to annular 110 and has latch/seal plate 585 to which dome 6 or MCL 400 can latch in an emergency situation. In this subassembly, containment dome 5 can engage either one of the two latch/seal plates 580 if needed and containment dome 6 or a MCL 400 can engage latch/plate 585 on mandrel 560.

Figure 12A:
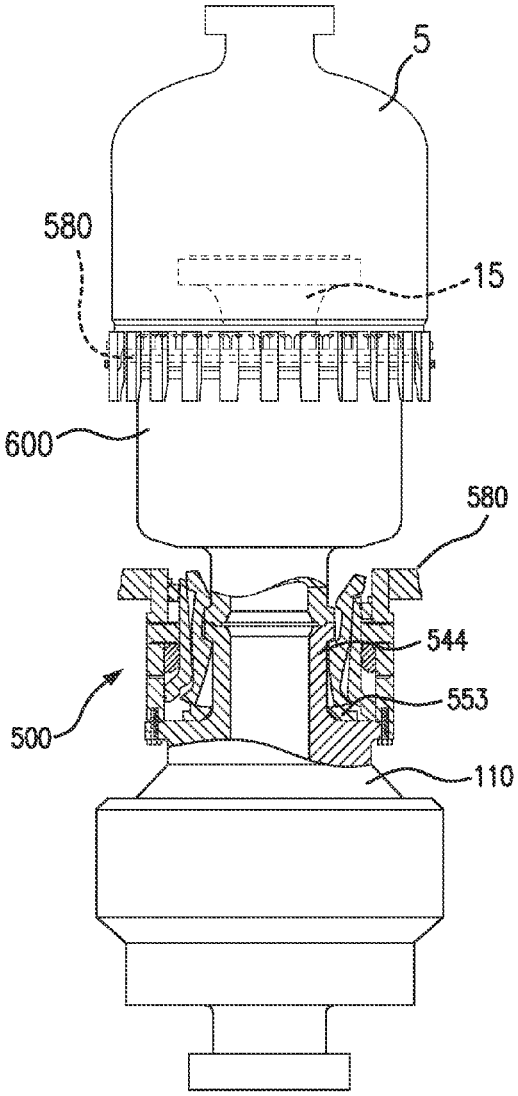
FIG. 12A illustrates a Flexconn I assembly in accordance with an embodiment of the current invention.
Figure 12B:
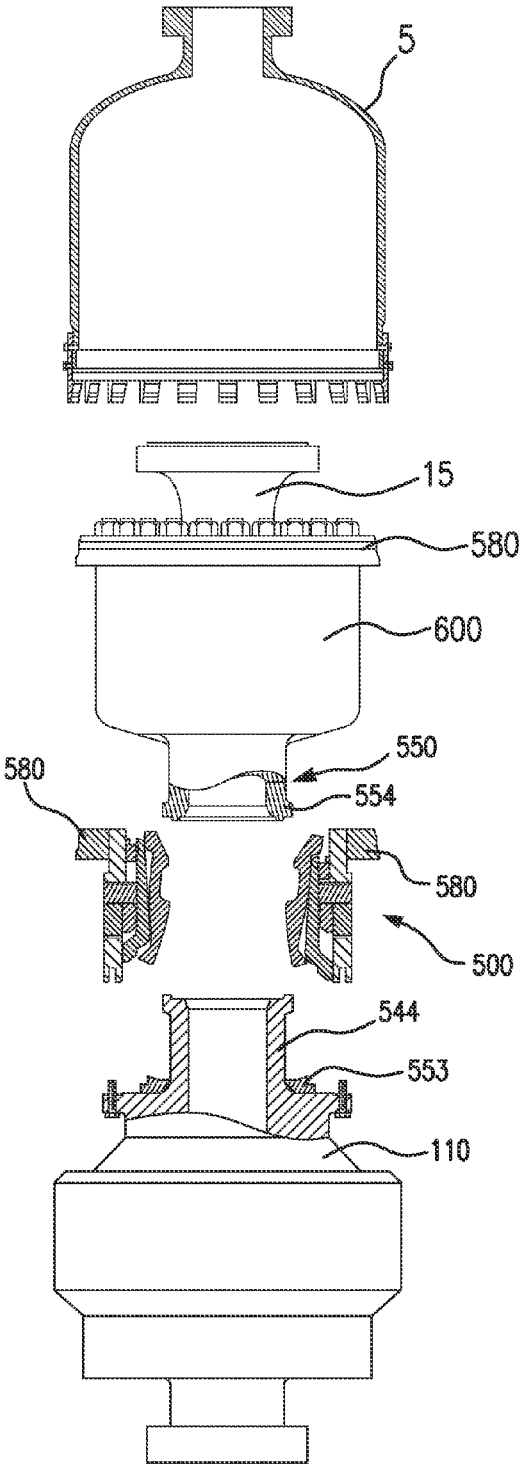
FIG. 12B is an exploded view of FIG. 12A depicting the body center section and the annular as a one piece.

Another embodiment of the RDP of the current invention is shown in FIGS. 12A and 12B. In this alternative configuration, FlexConn I subassembly, flex joint 600 couples to inverted connector 500 orientation and connector body center section 544 is integrated into the top plate of annular 110. Flex joint 600 includes mandrel 550 with profile 554 to engage connector 500. Connector 500 and flex joint 600 have latch/seal plate 580 to which dome 5 can latch if needed. The right hand side of the connector depicts a piston and segment in the unlock position in FIG. 12A and the left hand side illustrates the connector in the locked position.

Figure 13:
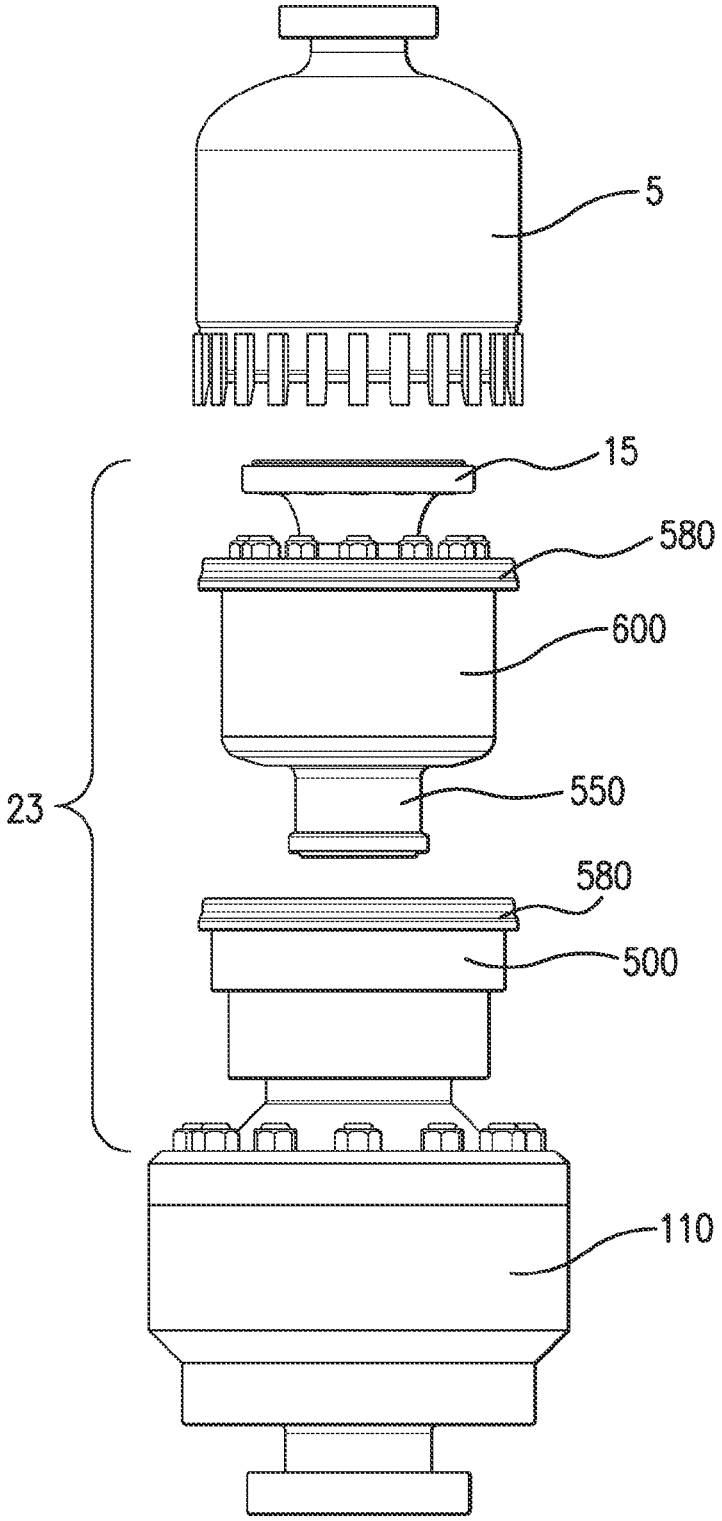
FIG. 13 illustrates a Flexconn I assembly and a modified annular in accordance with an embodiment of the present invention, in which the release connector is an integral part of the annular.

FIG. 13 depicts a different view of the same assembly shown in FIGS. 12A and 12B. Upon disconnection, the flex joint/mandrel come off as one unit and the connector/upper annular together as another unit.

Figure 14:
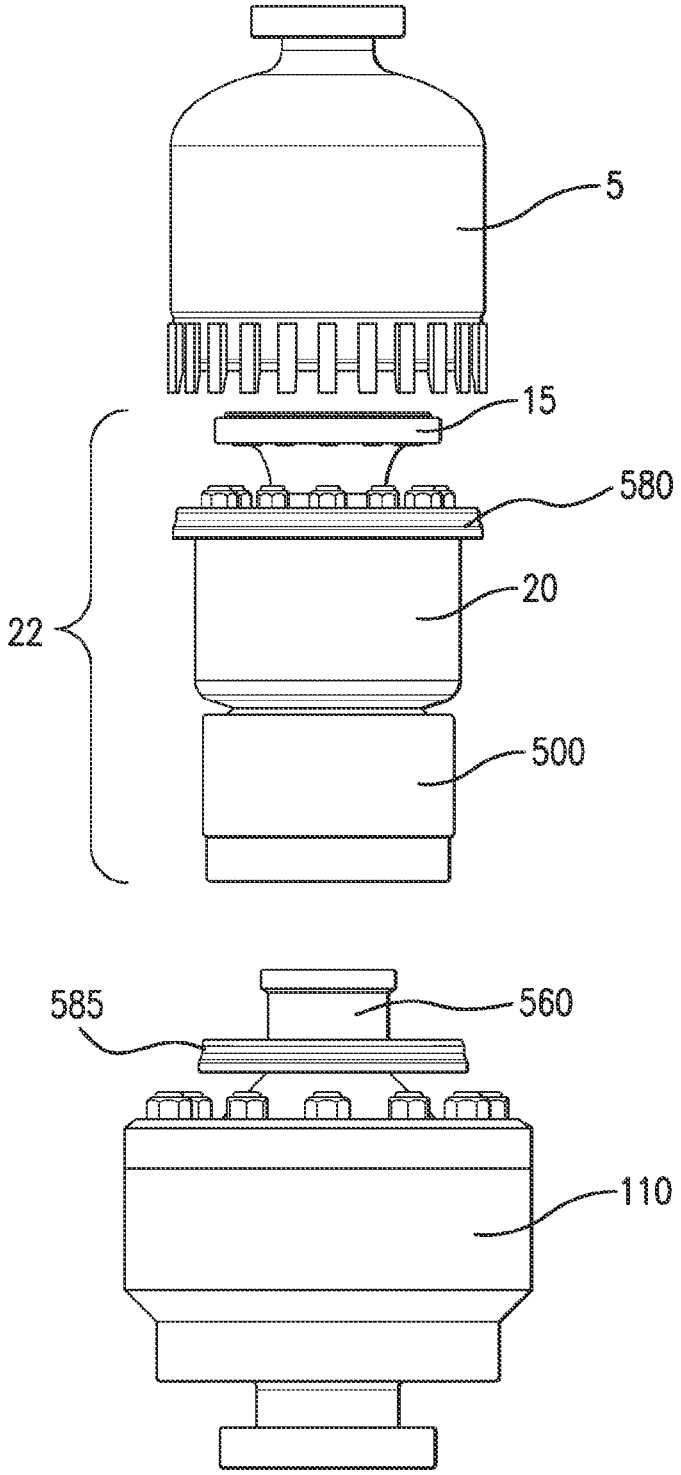
FIG. 14 illustrates a Flexconn S assembly and a modified annular in accordance with an embodiment of the present invention, in which the release connector is integrated into the flex joint and the mandrel for the connector is a modified mandrel/seal plate combination that is integral to the annular.

Similarly, FIG. 14 is a different view of the same assembly in FIGS. 11A and 11B. In the depicted embodiment, the flex joint/connector can be disconnected as one separate unit and the mandrel/annular as another.

Figure 15:
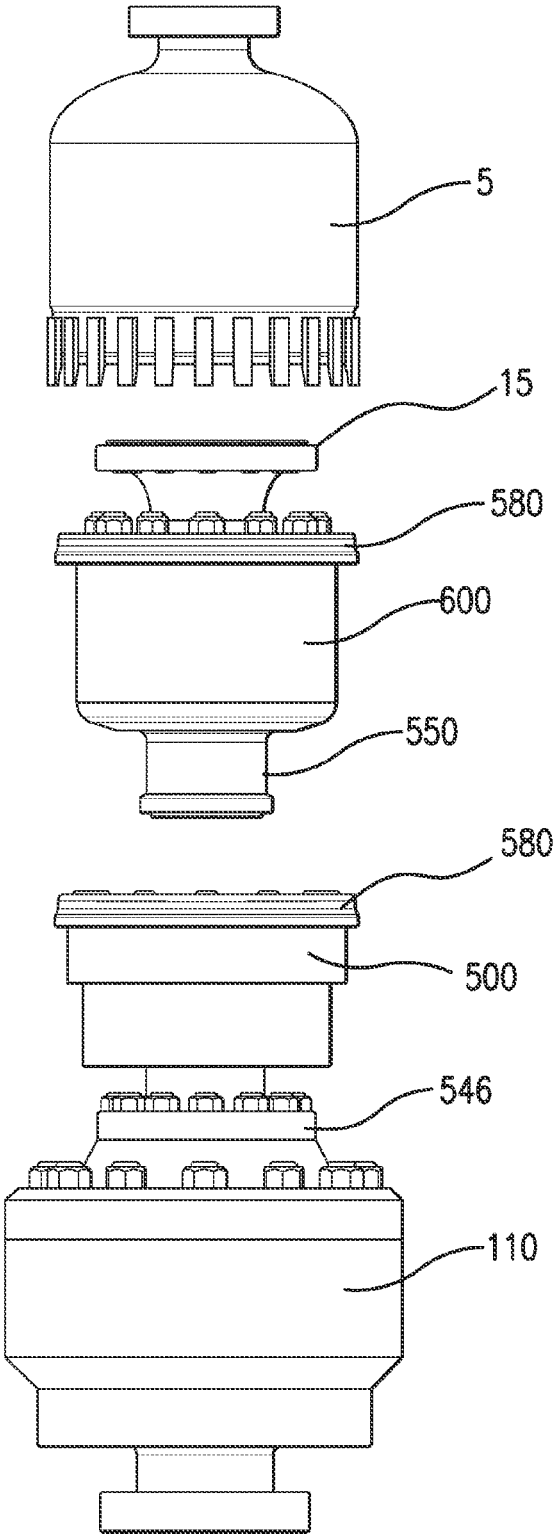
FIG. 15 illustrates a Flexconn I assembly and a modified annular in accordance with an embodiment of the present invention, in which the release connector is bolted to the top plate of the annular. The connector and the flex joint comprises a seal plate to effect engagement of a containment dome.

FIG. 15 is a different view of the same assembly of FIGS. 10A and 10B (illustrated without debris extruder 540). Upon disconnection, the flex joint/mandrel come off as one unit and the connector/annular as another separate unit. In this configuration, connector 500 is bolted to the top plate of annular 110 via body center flange 546.

Figure 16:
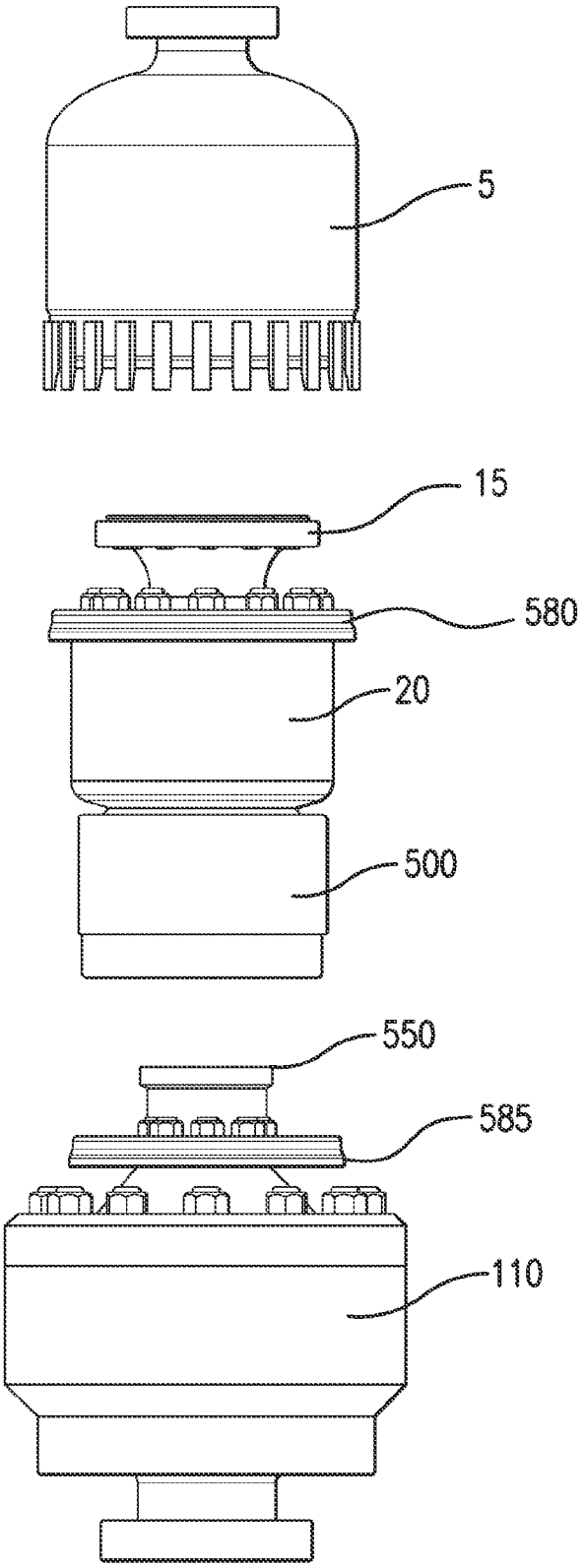
FIG. 16 illustrates a Flexconn S assembly with a mandrel/seal plate combination that is bolted to the annular.

FIG. 16 depicts a different view of the assembly of FIGS. 9A and 9B. In this configuration, the flex/connector dissociate as a single unit and the mandrel/seal plate/annular as a separate unit.

Figure 17A:
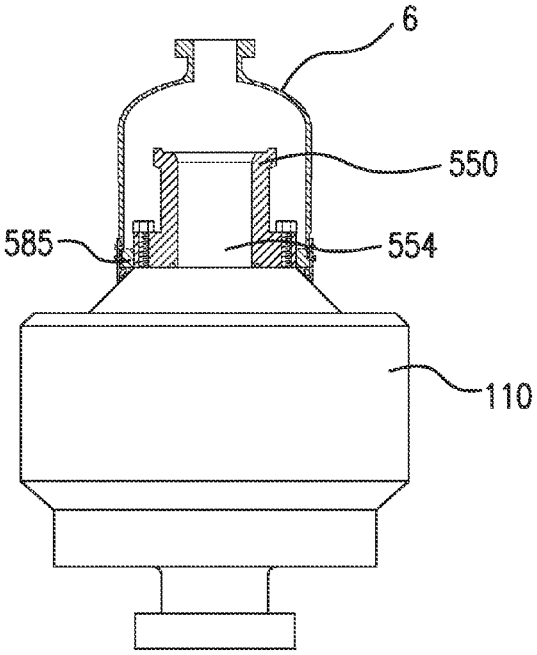
FIG. 17A illustrates the engagement of a containment dome with the latch/seal plate of a modified mandrel-latch/seal plate assembly that is bolted on the annular in the absence of a Riser Disconnect Package.
Figure 17B:
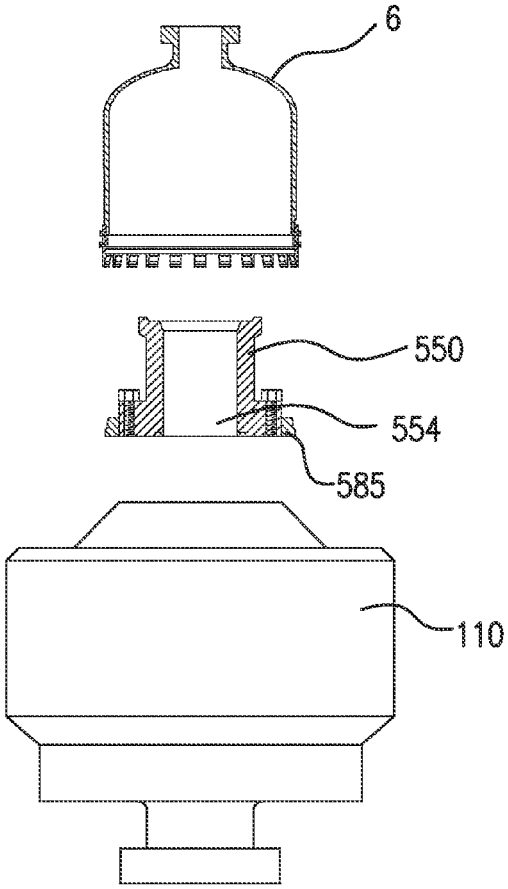
FIG. 17B is an exploded view of FIG. 17A.

In reference to FIGS. 17A and 17B, containment dome 5 engages seal plate 585 integrated into connector mandrel 550 that is bolted on top annular 110, without the presence of the RDP. Such an alternative intervention capability for well control or containment is not provided by prior art assemblies and is a unique aspect of the current invention.

Figure 18A:
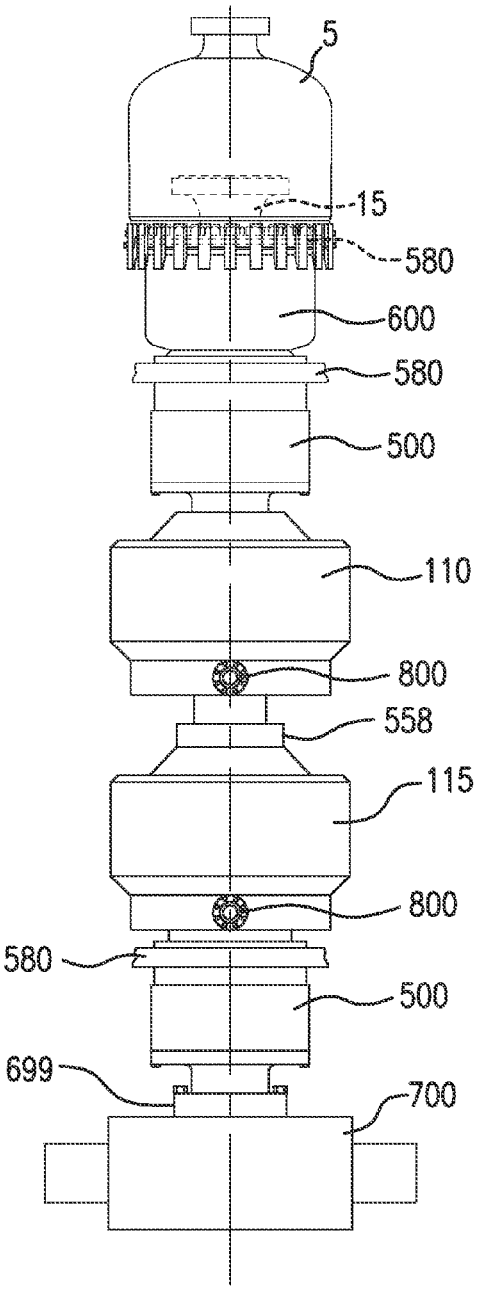
FIG. 18A illustrates a subsea assembly stack, according to an embodiment of the present invention, having a Flexconn I assembly, two annulars, a second connector and lower BOP ram.
Figure 18B:
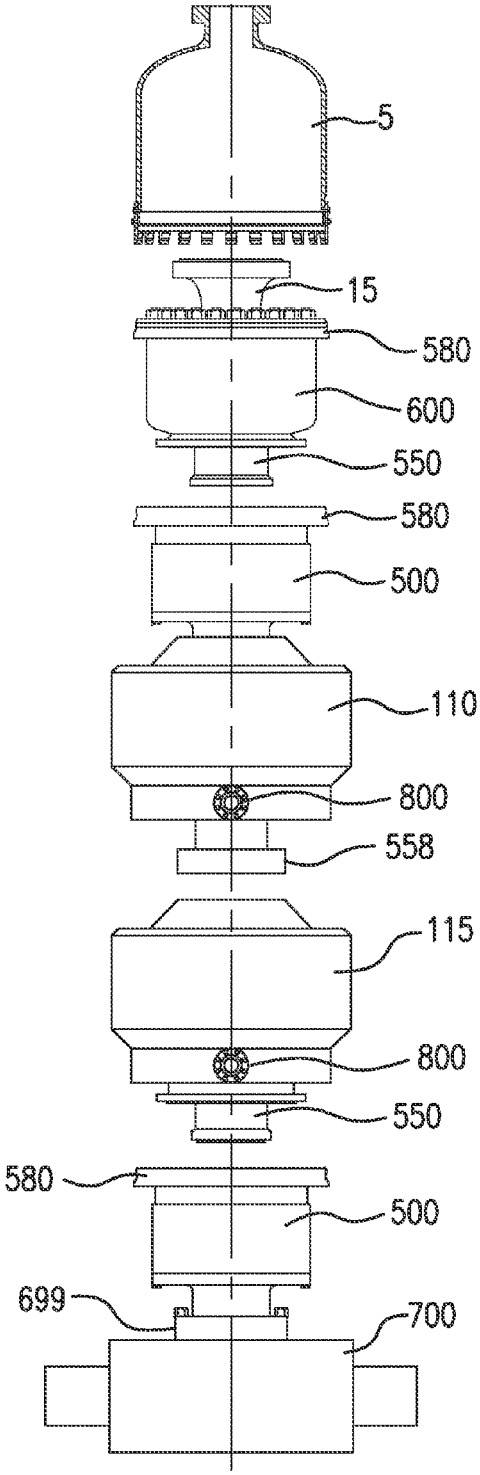
FIG. 18B is an exploded view of FIG. 18A.

A further embodiment of a subsea assembly in accordance with the current invention is illustrated in FIGS. 18A and 18B. Provided from top to bottom of the stack is flex joint 600 comprising a mandrel 550 in its lower section. As shown, mandrel 550, is connected to the lower body of the flex joint by an adapter flange. However, the mandrel and the flex joint maybe built from one forging so as to produce one integrated piece. Moreover, any flex joint 600 such as, for example, a commercially available unit may be used. Mandrel 550 engages a first connector 500 in an inverted orientation. In the stack, the flex joint—connector configuration is the Flexconn I subassembly. The top section of first connector 500 has latch/seal plate 580 and its lower section is integrated into upper annular 110. The first connector and the upper annular are a single unit. Upper annular 110, in turn, is attached to lower annular 115 by means of API flange 558. Bolted to the bottom section of lower annular 115 is mandrel 550 that engages second connector 500. The second connector 500 in turn is bolted to BOP ram 700 by API spool 699. API spools comprise two flanges connected by a plurality of nuts and bolts and are well known in the art. Containment dome 5 is capable of engaging the assembly at any one of three different latch/seal plates 580, the first is integrated with flex joint 600, the second is on the top section of a first connector 500, and the third on a second connector 500. Flex joint 600 is modified to include mandrel 550. Both annular BOPs, 110 and 115, are shown as having bypass ports 800. However, a person of skill in the art, realizes that these bypass ports are an optional aspect of the invention and may both, neither or only one be included. This embodiment provides two connectors, one on the upper annular and one on top of ram BOP 700 for attaching a capping stack.

Figure 19A:
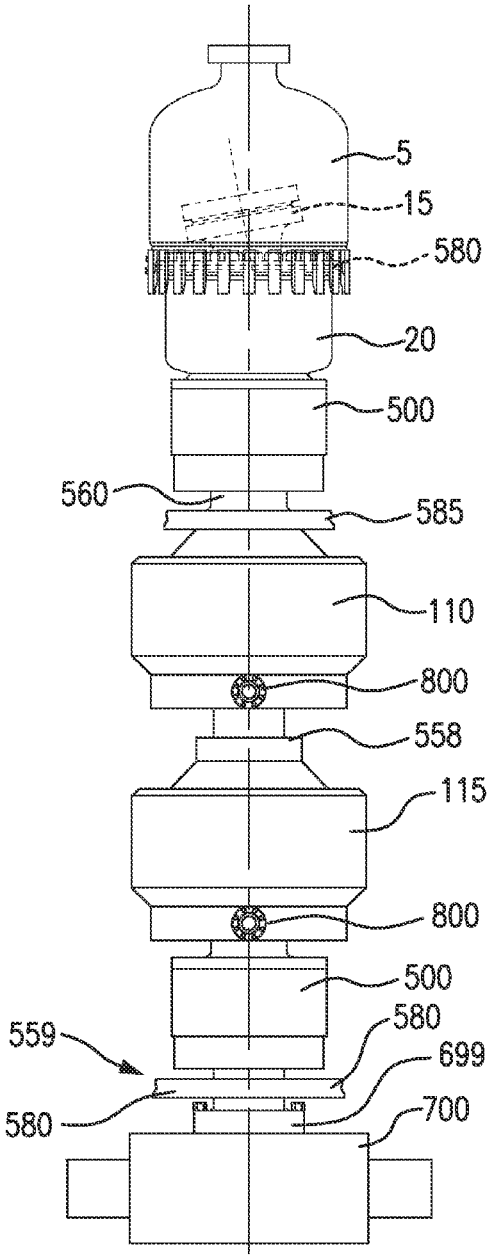
FIG. 19A illustrates an alternative embodiment of a subsea assembly stack in accordance with the current invention.
Figure 19B:
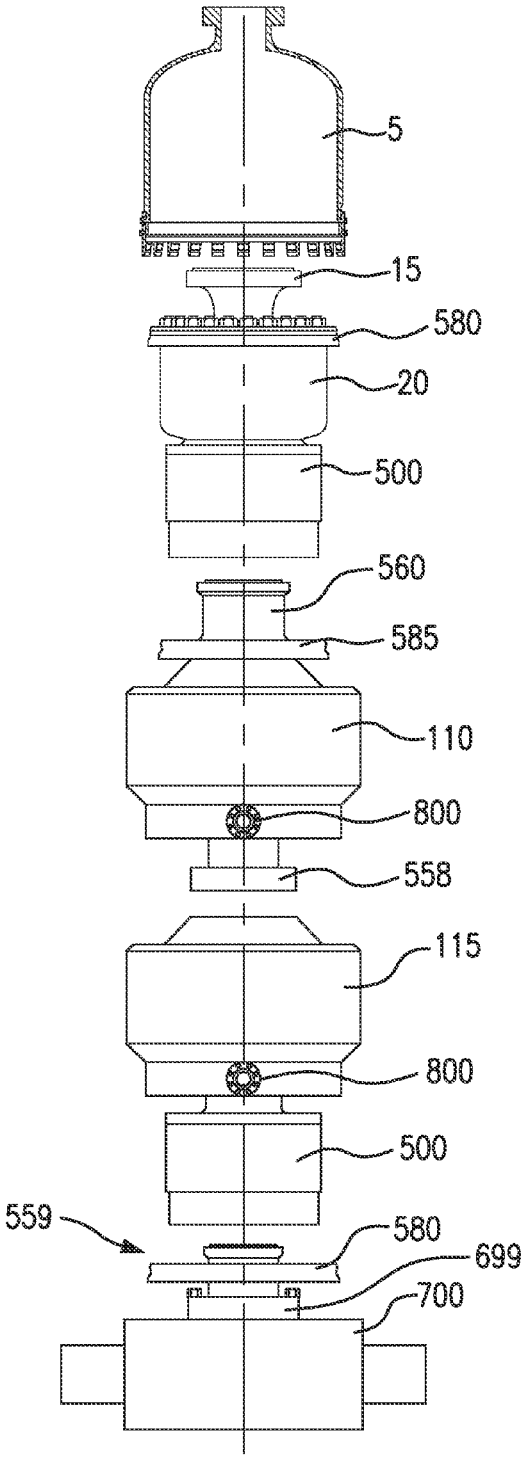
FIG. 19B is an exploded view of FIG. 19A.
Figure 20A:
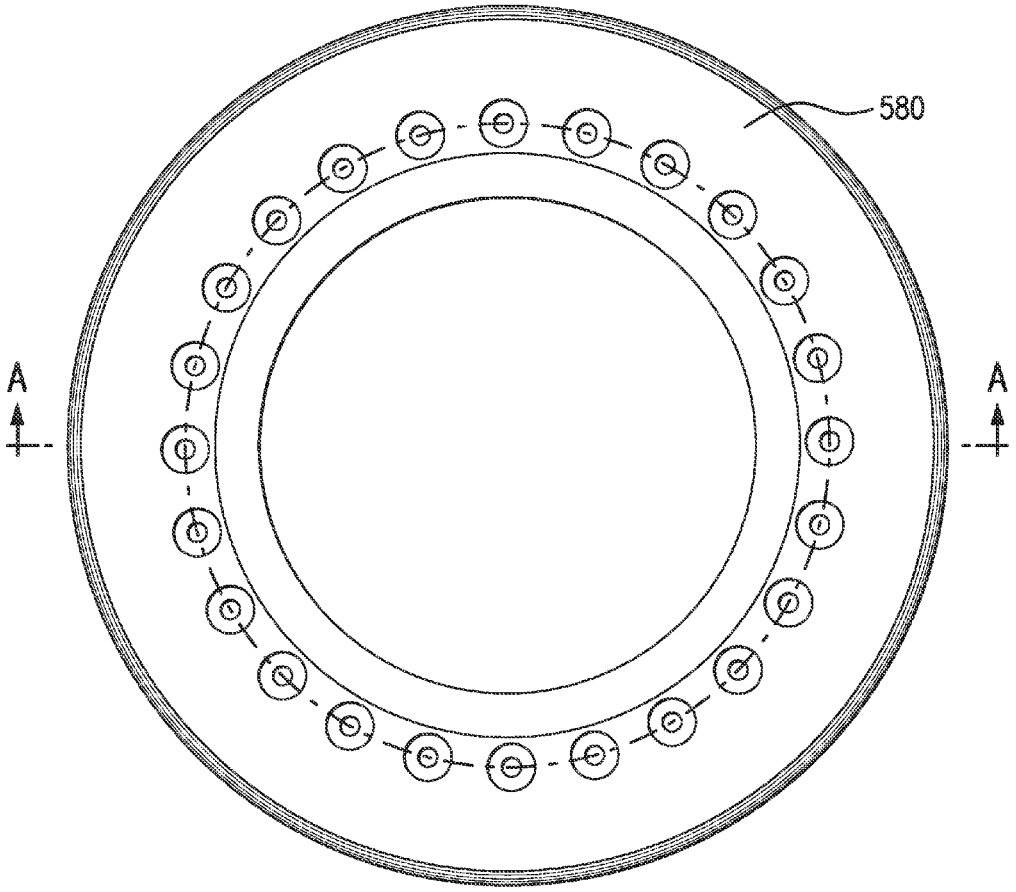
FIG. 20A depicts a top view and FIG. 20B a side view, along line A-A, of a seal plate, in accordance with the current invention.
Figure 20B:
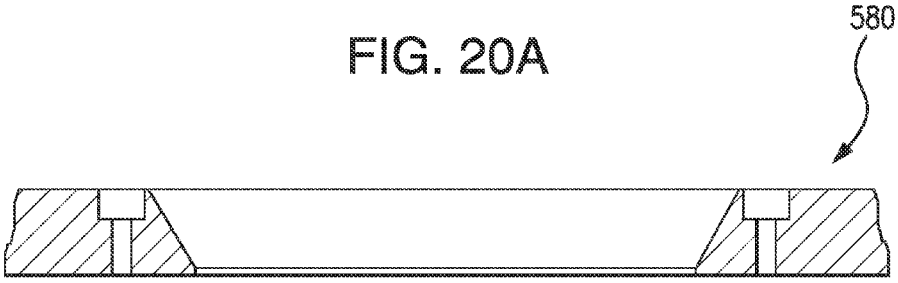

Yet a further aspect of the current invention is depicted in FIGS. 19A and 19B. Provided from top to bottom of the stack is flex joint 20 which is modified such that its lower section includes body center section of connector 500. In the stack, the flex joint-connector configuration is the FlexConn S subassembly in which connector 500 is in the standard orientation. Connector 500 engages mandrel 560 that is integrated into the top plate of upper annular 110. Upper annular 110 connects with lower annular 115 by means of API flange 558. Lower annular 115 is modified to integrate connector 500 on its lower section, which in turn engages mandrel 559 that is bolted by means of API spool 699 to ram BOP 700. API spools are readily known and available in the art. This embodiment has 3 latch/seal plates, latch/seal plate 580 on flex joint 20, latch/seal plate 585 on mandrel 560 and latch/seal plate 585 on mandrel 559, thereby providing 3 locations to effect the attachment of a containment dome and/or MLC when and if needed. It also provides two points for attaching a capping stack. The first point is mandrel 560 on top of upper annular 110 and the second point is mandrel 559 on top of upper ram BOP 700.

Figure 21A:
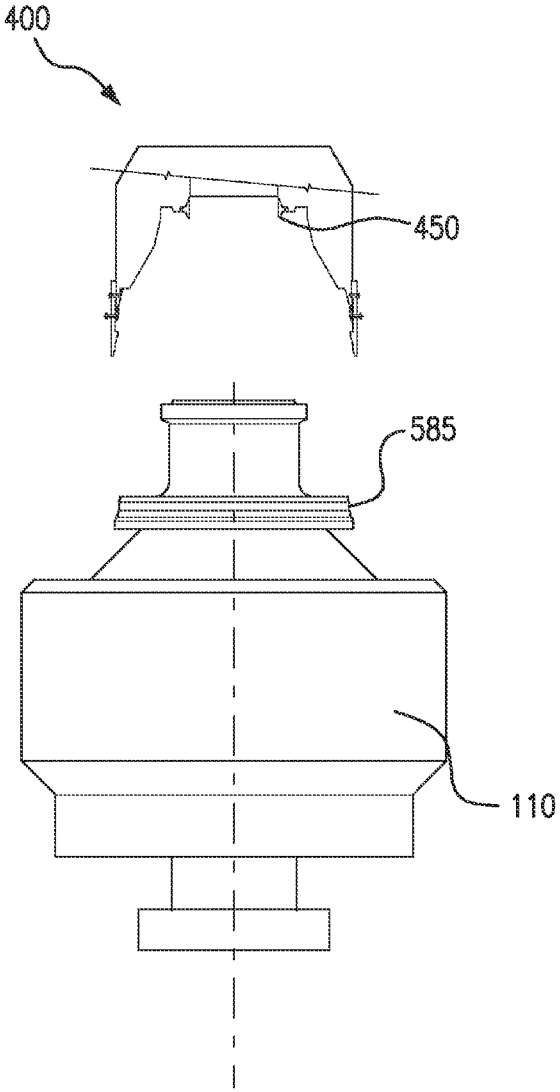
FIGS. 21A and 21B depict a side partial cut-away view of a mechanical locking connector (MLC) in accordance to an embodiment of the current invention.
Figure 21B:
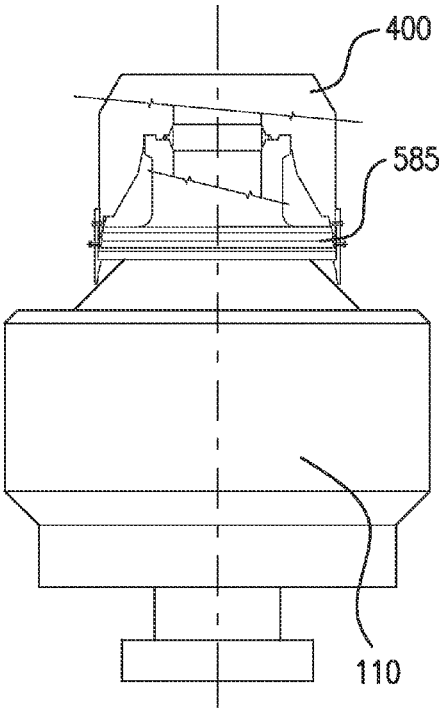

The current invention includes a mechanical locking connector 400 as shown in FIGS. 21A and 21B that can be used as an alternative to a containment dome or a capping stack in that it seals onto and encloses a mandrel profile 554, utilizing mandrel latch/seal plate 585. The mechanical locking connector can be used to seal at several locations in a subsea assembly, such as on a subsea Christmas tree, a wellhead or a BOP, or even on a pipeline. The mechanical locking connector is not hydraulically actuated and therefore, is particularly useful when a hydraulic supply is not available. Mechanical locking connector 400 includes a plurality of spring latches about the lower outer surface of the connector, similar to the spring latches shown in FIGS. 9C and 9D. Like the spring latches illustrated in FIGS. 9C and 9C, the spring latches may be affixed by a bolt to the connector. The spring latches will engage latch plate 585 in a manner similar to the engagement of the dome to plate 580 as shown in FIG. 9F. Mechanical locking connector 400 may comprise a rubber or metal seal ring 450 such as an AX gasket or other commercially available seal. Latch/seal plate 585 may include an external mating profile that is compatible with the internal profile of mechanical locking connector 400. An additional seal may be used at the interface of mating profile on the latch plate and internal profile of the locking connector. The connector is designed such that the force applied to the connector assembly 400 during the connection sequence effects the latching and energizing of the seal. As shown in FIGS. 21A and 21B, the seal assembly and mechanical latches are engaged simultaneously to effect the mechanical lock at the latch/seal plate 585 and pressure seal at the gasket 450 on the mandrel profile. Operation of the spring latches on the mechanical locking connector is similar to that described for the dome latch supra. As the mechanical locking connector is lowered on the mandrel, the spring latches contact a lead-in taper on the latch/seal plate and the weight of the mechanical connector spreads the spring latches radially outward. As the mechanical locking connector is lowered further, the spring latches pass over and spring radially inward over a latching shoulder on latch/seal plate 585. The contact of the spring latches with the latch/seal plate shoulder retains the mechanical locking connector in place. The connector may also be a low pressure or a high pressure connection device depending on the seal used (e.g., an elastomeric O-Ring versus a metal gasket). Removal of the mechanical locking connector is similar to the removal of the dome latch described supra. In design, the length, width, thickness and material of the spring latches may be adjusted to suit the loads and pressures that are expected to be retained by the connector. The mechanical connector 400 may also be used as an adapter within a containment dome so as to allow the dome to seal on a smaller size latch seal plate. The mechanical locking connector may be configured with a solid top when used as a cap or the top may include a center bore there through and configured as a flow line connection, an API flange, a clamp hub, or other well-known oilfield configurations to provide a host of connection options for subsequent operations as well understood by those skilled in the art.

As shown in FIG. 22, the subsea assemblies of the current invention may comprise a resident remote operated vehicle (ROV) system 155. The resident ROV system is designed as a compact, modular package that may be installed on the lower BOP stack, LMRP, the RDP of the current invention or any other major component of a subsea BOP stack. Installation of the resident ROV on the RDP is one preferred option as it would require only one wet mateable stab plate connection for the transfer of power, video and signal between the ROV module and the RDP. Installation of the ROV module on the LMRP or lower BOP stack, although possible, would require additional wet mateable stab plates for the connection between the RDP and the module where the ROV is installed. Multiple resident ROV systems could be installed on one subsea BOP stack as dictated by operational requirements and stack design. ROVs are well known in the art and the resident ROV system design and configuration is determined by task requirements that vary, for example, by drilling unit capability, water depth, BOP component configuration or the drilling program. A deepwater MODU is typically equipped with one or multiple work class ROV's to support a drilling program. A resident ROV can operate independent of, or in conjunction with, the MODU's work class ROV systems. The resident system is comprised of a vehicle, flying tether, tether management system and all ancillary components in a unitized module that can be removed and replaced as a singular plug and play unit. This replacement can be effected on the deck of the MODU or at depth with the assistance of a work class ROV. The resident ROV module may be installed in any convenient location within the structural framework of the lower BOP stack, the LMRP, the RDP or other subsea BOP stack component. The ROV system could be designed as all electric powered or a combination of electric and hydraulic powered and the system may be equipped with fiber-optic video and signal communication to and from the control console on the surface. The BOP mux control umbilical may contain fiber-optic components to facilitate this link. The dedicated ROV receives power and control information from the drilling vessel and transmits video and data to the surface control unit through the rig's mux control umbilical that is used to function the control pods on the LMRP. However, this does not preclude the use of an additional umbilical, deployed in conjunction with the mux control umbilical, to be used for the resident ROV. The system may have sufficient flying tether to provide the capability of accessing all components of the subsea BOP system for inspection and intervention or to assist with the operation of disconnecting the RDP from the LMRP and wet parking the MDR and, subsequently, reestablishing the RDP on the LMRP. The resident ROV is typically controlled from a control station(s) located on the MODU, but could be controlled from another surface support vessel through the use of radio frequency, or similar, wireless data and video transmission or from a shore based control system through the use of broadband satellite data transmission, or similar technology, as operations dictate. The ROV system module is designed to remain with the subsea equipment for the full duration of a drilling campaign and would be serviced while the subsea BOP system is on deck between well operations.

The resident ROV system may be utilized to perform daily BOP inspections, as often mandated by regulation, thus providing more flexibility for scheduling of repair and maintenance of the MODU's work class ROVs. The resident ROV may assist with the landing and connection of the LMRP to the lower BOP stack, the lower BOP stack to the wellhead or the connection of the RDP to the LMRP without the need to utilize the work class ROV. The ROV can also monitor and assist the connection of the drill pipe/running tool or auxiliary recovery winch line/running tool to the LMRP to effect a quick recovery of the lower BOP stack and/or LMRP to the deck of the MODU with the MDR wet parked. These are examples of work tasks that may be accomplished with the resident ROV but the work capability is not limited to these examples only. Additionally, it can also assist the MODU's work class ROV with tasks that benefit from additional camera views or intervention capability, assist with recovering a work class ROV that has become entangled or has lost power, or used to diagnose problems with the work class ROV while it is at depth. In addition, the resident system may provide rapid response to facilitate observation of intervention at the BOP stack or on the seabed around the BOP where the deployment of the work class ROV from the MODU to the seabed could take several hours to accomplish in deep water. This is particularly valuable in an emergency situation or during critical path rig operations. A resident ROV may have less capability than the MODU's work class ROV due to potential size constraints but provides enhanced capability to the overall support of the drilling, well completion or other MODU operations, and provides the opportunity to reduce the time taken to accomplish many normal drilling support tasks and to reduce rig downtime.

As shown in FIG. 22, the subsea assemblies of the current invention may comprise a BOP sonar system 900 to monitor the seabed and water column around the BOP stack. Subsea sonar systems are well known in the art and the type of sonar technology utilized on a BOP stack would be based on the operational requirements of a drilling or well completion system. The BOP sonar can be permanently installed on the lower BOP stack, the LMRP, the RDP or any other component of the subassembly of the current invention or prior art BOP stack, including RDP cage 51. An example of a preferred embodiment, has a sonar system installed on the RDP however, this does not preclude the possibility of installing a sonar system on any of the BOP stack major components. The sonar system components can be installed so as to afford a 360 degree view of the seabed and water column around the BOP stack. Sonar transceivers/receivers would be mounted on the structural cage of a major BOP component and in an area that offers an unobstructed view of the seabed and water column around the BOP stack. Sonar transceivers/receivers could be configured such that the components could be changed subsea using an ROV system. The system may use passive, active, or a combination of the two technologies depending on operational requirements. A topside control console sends control information to the sonar system through a Mux Control Umbilical as known by a skilled person in the art. Power to run the sonar could come from a subsea electrical junction box that is used to terminate a Mux Control Umbilical in either the LMRP or RDP depending on the overall BOP system configuration. Sonar data would be displayed onboard the MODU, typically in the rig control room, at the drilling console and/or in the ROV control room or could be transmitted to another surface vessel or to a shore location for monitoring and/or interpretation.

The BOP sonar system can be used to monitor the seabed for gas or oil seepage from the reservoir and could also be utilized to detect objects approaching the BOP stack along the seabed or in the water column. Sonar data may also be used to aid in ROV positioning and navigation around the BOP or on seabed in the vicinity of the BOP. A sonar system could be used to monitor an ROV that has become detached from its flying tether and determine the direction in which it is moving away, the speed in which it is travelling from the wellhead and the rate at which it is rising to the surface. Such information may be critical to the success of recovering a lost ROV which can have a significant impact on rig downtime. Furthermore, a sonar system can be used to monitor the position of the MDR while it is wet parked during LMRP and/or BOP stack recovery. Additionally, the BOP sonar system could be used to determine the location of dropped objects on the seabed. This list of tasks is merely illustrative and is not to be taken as limiting the scope of the invention It will be understood by one of ordinary skill in the art that in general any subset or all of the various embodiments and inventive features described herein may be combined, notwithstanding the fact that the claims set forth only a limited number of such combinations.

What is claimed is:

1. A hydraulically-actuated release connector for a subsea assembly comprising:

a plurality of gripping segments, wherein said gripping segments rotationally pivot between a locked position in which the segments clamp to a mandrel and an unlocked position in which the mandrel is released, the plurality of gripping segments having an elongated body extending from a first end to a second end, the first end having an inner locking profile while the second end having a contoured segment hook;

an annular piston, wherein said piston is located adjacent to said gripping segments and operable to move said segments between said locked and unlocked positions, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook;

at least one hydraulic unlock port in communication with said piston;

a hydraulic lock port in communication with said piston;

a center body section disposed within said plurality of segments and configured to form a seal with said mandrel when said segments are in said locked position, wherein said annular piston and said plurality of gripping segments have complementary offset radiused contact surfaces; and an actuator piston head connected to said piston movable between a lock position and an unlock position, wherein said hydraulic lock port is in communication with said actuator piston head and wherein as the actuator piston strokes, the contact force between the plurality of segments and the annular piston gradually decreases.

2. The release connector of claim 1, wherein the release connector connects a flex joint to a lower marine riser package.

3. The release connector of claim 1, wherein the release connector couples an annular blow out preventer to a ram blowout preventer.

4. The release connector of claim 1, further comprising a seal plate integrated into the top part of the connector.

5. The release connector of claim 1, wherein said center body section is bolted to an annular blow out preventer.

6. The release connector of claim 1, wherein said center body section is integral to an annular blow out preventer.

7. The release connector of claim 1, wherein said center body section is bolted to flex joint by means of an adapter plate.

8. A marine riser disconnect package for rapid connecting and disconnecting a marine drilling riser to or from a lower mariner riser package, said riser disconnect package comprising a flex joint, the hydraulically-actuated release connector of claim 1 and a connector mandrel, wherein said release connector functionally connects the flex joint and the mandrel.

9. The marine riser disconnect package of claim 8, wherein the release connector is an integral part of the flex joint.

10. The marine riser disconnect package of claim 8, wherein said release connector further comprises a debris excluder.

11. The marine riser disconnect package of claim 8, further comprising a structural cage framing the riser disconnect package.

12. The marine riser disconnect package of claim 8, wherein the structural cage framing the mariner riser disconnect package is capable of engaging a complementary structural cage surrounding a lower mariner riser package.

13. The marine riser disconnect package of claim 8, further comprising at least one seal plate to engage a containment dome.

14. The mariner riser disconnect package of claim 8, comprising two seal plates to engage a containment dome, wherein said first seal plate is positioned on the flex joint and said second seal plate is either on said hydraulically-actuated release connector or on said connector mandrel.

15. The marine riser disconnect package of claim 11, further comprising a resident remotely operated vehicle housed in or on said structural cage.

16. The marine riser disconnect package of claim 11, further comprising a sonar system installed on said structural cage.

17. A subsea assembly for an offshore well comprising in a functional order:

a flex joint configured on one end to engage a marine drilling riser;

the hydraulically-actuated release connector of claim 1 configured to engage a second end of said flex joint a connector mandrel configured to engage said release connector; and an annular blow out preventer having a top section and a bottom section, wherein said connector mandrel is an integral part of said top section.

18. The subsea assembly of claim 17 further comprising a second annular blow out preventer and a second hydraulically-actuated release connector.

19. The subsea assembly of claim 17 further comprising a seal plate on said connector mandrel, wherein said seal plate is configured to receive and latch to a containment dome.

20. The subsea assembly of claim 19, further comprising a second seal plate wherein said second seal plate is attached to said flex joint.

21. The subsea assembly of claim 17, further comprising a second connector mandrel configured to engage said second release connector wherein said second connector mandrel comprises integrated within a third seal plate.

22. The subsea assembly of claim 17, wherein said flex joint and said connector mandrel are housed in a first cage and the said first annular blow out preventer and said second annular blow out preventer are housed in a second cage, such that said first cage is configured to mate with the second cage.

23. The subsea assembly of claim 17, wherein said annular blow out preventer comprises at least one by-pass port.

24. A hydraulically-actuated release connector for a subsea assembly comprising:

a) a plurality of gripping segments, wherein said gripping segments rotationally pivot between a locked position in which the segments clamp to a mandrel and an unlocked position in which the mandrel is released, the plurality of gripping segments having an elongated body extending from a first end to a second end, the first end having an inner locking profile while the second end having a contoured segment hook;

b) an annular piston, wherein said piston is located adjacent to said gripping segments and operable to move said segments between said locked and unlocked positions, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook;

c) at least one hydraulic unlock port in communication with said piston;

d) a hydraulic lock port in communication with said piston;

e) a center body section disposed within said plurality of segments and configured to form a seal with said mandrel when said segments are in said locked position, wherein said annular piston and said plurality of gripping segments have complementary offset radiused contact surfaces, wherein the hydraulically-actuated release connector is configured for use in an inverted configuration; and a saddle secured to the center body and configured to receive the second end of the plurality of gripping segments, wherein the second end slidingly engages with a contoured surface of the saddle as the plurality of gripping segments transition between the locked and unlocked positions.

25. The release connector of claim 24 further comprising an actuator piston head connected to said piston movable between a lock position and an unlock position, wherein said hydraulic lock port is in communication with said actuator piston head and wherein as the actuator piston strokes, the contact force between the plurality of segments and the annular piston gradually decreases.

26. A Flexconn assembly comprising:

a flex joint and a hydraulically-actuated release connector attached to said flex joint, wherein said hydraulically-actuated release connector comprises:

a) a plurality of gripping segments, wherein said gripping segments rotationally pivot between a locked position in which the connector clamps to a mandrel and an unlocked position in which the mandrel is released, the plurality of gripping segments having an elongated body extending from a first end to a second end, the first end having an inner locking profile while the second end having a contoured segment hook;

b) an annular piston, wherein said piston is located adjacent to said gripping segments and operable to move said segments between said locked and unlocked positions, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook;

c) at least one hydraulic unlock port in communication with said piston;

d) a hydraulic lock port in communication with said actuator piston head; and e) a center body section disposed within said plurality of segments and configured to form a seal with said mandrel when said segments are in said locked position, wherein said annular piston and said plurality of gripping segments have complementary offset radiused contact surfaces; and f) an actuator piston head connected to said piston movable between a lock position and an unlock position, wherein said hydraulic lock port is in communication with said actuator piston head and wherein as the actuator piston strokes, the contact force between the plurality of segments and the annular piston gradually decreases.

27. The Flexconn assembly of claim 26, wherein the flex joint is attached to the connector by an adaptor flange and wherein the connector is in the standard face up configuration.

28. The Flexconn assembly of claim 26, wherein the connector is in the inverted configuration and wherein the flex joint comprises an upper section and a lower section, and wherein the lower section comprises a mandrel profile integrated into said lower section and engages said connector.

29. A Flexconn assembly comprising: a flex joint and a hydraulically-actuated release connector attached to said flex joint, wherein said hydraulically-actuated release connector comprises:

a) a plurality of gripping segments, wherein said gripping segments rotationally pivot between a locked position in which the connector clamps to a mandrel and an unlocked position in which the mandrel is released, the plurality of gripping segments having an elongated body extending from a first end to a second end, the first end having an inner locking profile while the second end having a contoured segment hook;

b) an annular piston, wherein said piston is located adjacent to said gripping segments and operable to move said segments between said locked and unlocked positions, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook;

c) at least one hydraulic unlock port in communication with said piston;

d) a hydraulic lock port in communication with said actuator piston head;

a saddle secured to the center body and configured to receive the second end of the plurality of gripping segments, wherein the second end slidingly engages with a contoured surface of the saddle as the plurality of gripping segments transition between the locked and unlocked positions; and a center body section disposed within said plurality of segments and configured to form a seal with said mandrel when said segments are in said locked position, wherein said annular piston and said plurality of gripping segments have complementary radiused contact surfaces, wherein the connector is in an inverted configuration.

30. The Flexconn assembly of claim 29, further comprising an actuator piston head connected to said piston movable between a lock position and an unlock position, and wherein said hydraulic lock port is in communication with said actuator piston head and wherein as the actuator piston strokes, the contact force between the plurality of segments and the annular piston gradually decreases.

31. A marine riser disconnect package for rapid connecting and disconnecting a marine drilling riser to or from a lower mariner riser package, said riser disconnect package comprising a flex joint, a hydraulically-actuated release connector and a connector mandrel, wherein said release connector functionally connects the flex joint and the mandrel and wherein said connector comprises a plurality of segments, the plurality of segments having an elongated body extending from a first end to a second end, the first end having an inner locking profile while the second end having a contoured segment hook and an annular piston, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook and having offset radiused contact surfaces and wherein said connector mandrel is integrated in the flex joint and said release connector engages the connector mandrel in an inverted configuration and a saddle secured to the center body and configured to receive the second end of the plurality of gripping segments, wherein the second end slidingly engages with a contoured surface of the saddle as the plurality of gripping segments transition between the locked and unlocked positions.

32. The marine riser disconnect package of claim 31, wherein said release connector further comprises a saddle positioned under said plurality of segments so as to provide support to said plurality of segments.

33. A subsea assembly for an offshore well comprising in a functional order:

a) a flex joint comprising an upper section to engage a marine drilling riser and a lower section;

b) a connector mandrel, wherein said connector mandrel is integrated into the lower section of the flex joint;

c) a hydraulically-actuated release connector configured to engage said connector mandrel and comprising i) a plurality of gripping segments, wherein said gripping segments rotationally pivot between a locked position in which the segments clamp to a mandrel and an unlocked position in which the mandrel is released, the plurality of gripping segments having an elongated body extending from a first end to a second end, the first end having an inner locking profile while the second end having a contoured segment hook;

ii) an annular piston, wherein said piston is located adjacent to said gripping segments and operable to move said segments between said locked and unlocked positions, the annular piston being an integral body and extending around a periphery of the plurality of gripping segments, the annular piston having a contoured knuckle section configured to slidingly engage with contoured segment hook, wherein the piston knuckle unlocks the plurality of gripping segments via the segment hook;

iii) at least one hydraulic unlock port in communication with said piston; iv)

iv) a hydraulic lock port in communication with said piston;

v) an actuator piston head connected to said piston movable between a lock position and an unlock position, wherein said hydraulic lock port is in communication with said actuator piston head and wherein as the actuator piston strokes, the contact force between the plurality of segments and the annular piston gradually decreases; and vi) a center body section disposed within said plurality of segments and configured to form a seal with said mandrel when said segments are in said locked position, wherein said annular piston and said plurality of gripping segments have offset complementary radiused contact surfaces; and d) an annular blow out preventer, wherein said release connector is an integral part of said annular blow out preventer and comprises a plurality of segments and an annular piston having offset radiused contact surfaces.

34. The subsea assembly of claim 33 further comprising a second annular blow out preventer and a second hydraulically-actuated release connector.

35. The subsea assembly of claim 33, further comprising a seal plate configured to receive and latch to a containment dome.

36. The subsea assembly of claim 33 comprising a first, a second and a third seal plate wherein the first seal plate is attached to the flex joint, the second seal plate is attached to the first release connector and the third seal is attached to the second release connector.

37. The subsea assembly of claim 33, wherein the flex joint and the connector mandrel are housed in a first cage and the first annular and the second annular are housed in a second cage, such that the first cage is configured to mate with the second cage.

38. The subsea assembly of claim 33, wherein the annular comprises at least one by-pass port.

39. The subsea assembly of claim 33, wherein the hydraulically-actuated release connector is in an inverted configuration.

* * * * *